US012221762B2

(12) United States Patent
Stroyer

(10) Patent No.: US 12,221,762 B2
(45) Date of Patent: Feb. 11, 2025

(54) DISPLACEMENT PILE AND PILE DRIVER ADAPTER

(71) Applicant: Benjamin G. Stroyer, East Rochester, NY (US)

(72) Inventor: Benjamin G. Stroyer, East Rochester, NY (US)

( * ) Notice: Subject to any disclaimer, the term of this patent is extended or adjusted under 35 U.S.C. 154(b) by 141 days.

(21) Appl. No.: 17/528,642

(22) Filed: Nov. 17, 2021

(65) Prior Publication Data

US 2022/0162822 A1 May 26, 2022

Related U.S. Application Data

(63) Continuation-in-part of application No. PCT/US2020/034122, filed on May 22, 2020.

(60) Provisional application No. 62/980,352, filed on Feb. 23, 2020, provisional application No. 62/980,371, filed on Feb. 23, 2020, provisional application No. 62/915,729, filed on Oct. 16, 2019, provisional application No. 62/851,583, filed on May 22, 2019.

(51) Int. Cl.

| | |
|---|---|
| ***E02D 5/56*** | (2006.01) |
| ***E02D 5/28*** | (2006.01) |
| ***E02D 5/46*** | (2006.01) |

(52) U.S. Cl.

CPC ..... *E02D 5/56* (2013.01)

(58) Field of Classification Search

CPC ..... E02D 5/56; E02D 7/22

See application file for complete search history.

(56) References Cited

U.S. PATENT DOCUMENTS

| | | | |
|---|---|---|---|
| 109,337 | A | 11/1870 | Moseley |
| 935,081 | A | 9/1909 | Wolfsholz |
| 1,307,160 | A | 6/1919 | Stokes |
| 1,348,994 | A | 8/1920 | Heckle |
| 1,566,631 | A | 12/1925 | Sturtevant |
| 2,501,369 | A | 3/1950 | Zavatkay |
| 2,911,239 | A | 11/1959 | Marzolf, Sr. |

(Continued)

FOREIGN PATENT DOCUMENTS

| | | |
|---|---|---|
| CN | 201843129 | 5/2011 |
| CN | 201981535 | 9/2011 |

(Continued)

OTHER PUBLICATIONS

Supplementary Partial European Search Report for EP20809436 (Nov. 29, 2022) Nov. 29, 2022.

(Continued)

*Primary Examiner* — Frederick L Lagman
*Assistant Examiner* — Stacy N Lawson
(74) *Attorney, Agent, or Firm* — Dawson Law Firm, P.C.; Michael J. Nickerson

(57) ABSTRACT

A bi-directional swing pile adapter includes a first ring; a first support arm; a second support arm; a first swivel connector to operatively connect the first ring to the first support arm in a swivel manner; a second swivel connector to operatively connect the first ring to the second support arm in a swivel manner; a pile coupling member to enable coupling to a pile; a third swivel connector to operatively connect the first ring to the pile coupling member in a swivel manner; and a fourth swivel connector to operatively connect the first ring to the pile coupling member in a swivel manner.

13 Claims, 39 Drawing Sheets

(56) References Cited

U.S. PATENT DOCUMENTS

| | | | | |
|---|---|---|---|---|
| 3,149,851 | A | 9/1964 | Adams | |
| 3,243,962 | A | 4/1966 | Ratliff | |
| 3,690,109 | A | 9/1972 | Turzillo | |
| 3,875,751 | A | 4/1975 | Paus | |
| 3,969,902 | A | 7/1976 | Ichise et al. | |
| 4,072,017 | A | 2/1978 | Shiraki | |
| 4,360,599 | A | 11/1982 | Loken et al. | |
| 4,504,173 | A * | 3/1985 | Feklin | E02D 5/36 405/243 |
| 4,533,279 | A | 8/1985 | van den Elzen et al. | |
| 4,659,259 | A | 4/1987 | Reed et al. | |
| 5,145,286 | A | 9/1992 | Summers | |
| 5,219,246 | A | 6/1993 | Coutts et al. | |
| 5,378,085 | A | 1/1995 | Kono et al. | |
| 5,575,593 | A | 11/1996 | Raaf | |
| 5,707,180 | A | 1/1998 | Vickars et al. | |
| 5,722,498 | A * | 3/1998 | Van Impe | E02D 5/36 175/394 |
| 5,907,447 | A | 5/1999 | Sutton et al. | |
| 5,919,005 | A | 7/1999 | Rupiper | |
| 5,934,836 | A | 8/1999 | Rupiper et al. | |
| 6,033,152 | A | 3/2000 | Blum | |
| 6,264,402 | B1 | 7/2001 | Vickars et al. | |
| 6,283,231 | B1 | 9/2001 | Coelus | |
| 6,402,432 | B1 | 6/2002 | England et al. | |
| 6,435,776 | B2 | 8/2002 | Vickars et al. | |
| 6,503,024 | B2 | 1/2003 | Rupiper | |
| 6,615,554 | B2 | 9/2003 | Rupiper | |
| 6,652,195 | B2 | 11/2003 | Vickars et al. | |
| 6,672,015 | B2 | 1/2004 | Cognon | |
| 6,722,821 | B1 | 4/2004 | Perko et al. | |
| 6,799,924 | B1 | 10/2004 | Kight et al. | |
| 6,814,525 | B1 | 11/2004 | Whitsett | |
| 6,902,352 | B2 | 6/2005 | Kim | |
| 6,966,727 | B2 | 11/2005 | Kight et al. | |
| 7,004,683 | B1 | 2/2006 | Rupiper | |
| 7,198,434 | B2 | 4/2007 | Blum | |
| 7,314,335 | B2 | 1/2008 | Whitsett | |
| 7,338,232 | B2 | 3/2008 | Nasr | |
| 8,033,757 | B2 | 10/2011 | Stroyer | |
| 8,070,391 | B2 | 12/2011 | White | |
| 9,284,708 | B2 | 3/2016 | Neville | |
| 2001/0045067 | A1 | 11/2001 | Cognon | |
| 2004/0105727 | A1 | 6/2004 | Jones | |
| 2005/0031418 | A1 | 2/2005 | Whitsett | |
| 2006/0013656 | A1 * | 1/2006 | Blum | E21B 10/44 175/323 |
| 2006/0260849 | A1 | 11/2006 | Pedrelli | |
| 2007/0286685 | A1 | 12/2007 | Lindsey | |
| 2007/0286686 | A1 | 12/2007 | Lindsey | |
| 2008/0063479 | A1 | 3/2008 | Stroyer | |
| 2008/0131211 | A1 * | 6/2008 | NeSmith | E02D 5/36 405/241 |
| 2010/0247247 | A1 | 9/2010 | Neville | |
| 2014/0377011 | A1 | 12/2014 | Yingling et al. | |
| 2015/0176238 | A1 * | 6/2015 | Stroyer | E02D 5/52 405/253 |
| 2017/0218590 | A1 * | 8/2017 | Raposo | E02D 5/00 |
| 2017/0342674 | A1 * | 11/2017 | Masse | E02D 7/22 |
| 2018/0030681 | A1 | 2/2018 | Stroyer | |
| 2018/0258602 | A1 * | 9/2018 | Kemp | E02D 5/56 |
| 2019/0271131 | A1 * | 9/2019 | Perko | E02D 5/56 |
| 2021/0002843 | A1 * | 1/2021 | Kemp | F24T 10/17 |

FOREIGN PATENT DOCUMENTS

| | | | | |
|---|---|---|---|---|
| CN | 106194030 | | 7/2018 | |
| CN | 108265708 | | 7/2018 | |
| EP | 0747537 | | 12/1996 | |
| GB | 687592 | | 2/1953 | |
| GB | 910089 | | 11/1962 | |
| JP | 60013118 | | 1/1985 | |
| JP | 05086791 | | 4/1993 | |
| JP | 2002356846 | | 12/2002 | |
| KR | 20070009003 | | 1/2007 | |
| KR | 100841735 | | 6/2008 | |
| KR | 100894988 | | 4/2009 | |
| KR | 20150049105 | | 5/2015 | |
| KR | 101761734 | | 7/2017 | |
| WO | WO2004020744 | | 3/2009 | |
| WO | WO2015003074 | | 1/2015 | |
| WO | WO-2015093642 | A1 * | 6/2015 | E21B 7/201 |
| WO | WO2018076054 | | 5/2018 | |

OTHER PUBLICATIONS

English Translation of Korean Patent No. KR20070037190, dated Apr. 4, 2010 (21 pages).

English Translation of Korean patent No. KR200462047, dated Aug. 22, 2012, (31 Pages).

Extended European Search Report for EP20809436.7 (Feb. 2, 2023 Feb. 2, 2023.

English Translation Japanese Patent Abstract JP60013118, 1 page.

English Translation Japanese Patent Abstract JP2002167759, 1 page.

English Translation Japanese Patent Abstract JP2002356846, 1 page.

International Preliminary Report on Patentability for PCT/US2020/0341122 (Dec. 2, 2021) Dec. 2, 2021.

International Search Report and Written Opinion for PCT/US2020/0341122 (Oct. 15, 2020) Oct. 15, 2020.

Korean Intellectual Property Office International Search Report for PCT/US2010/050869, dated Feb. 24, 2011 Feb. 24, 2011.

Standard Specification for Deformed and Plain Carbon-Steel Bars for Concrete Reinforcement (A615/A615M-20) 2020 Jan. 1, 2020.

International Search Report for PCT/US2019/057208, dated Jan. 17, 2020 Jan. 17, 2020.

* cited by examiner

DISPLACEMENT PILE AND PILE DRIVER ADAPTER

PRIORITY INFORMATION

The present application is a continuation-in-part application of PCT Patent Application Number PCT/US2020/034122, filed on May 22, 2020, and claims priority, under 35 U.S.C. § 120, from PCT Patent Application Number PCT/US2020/034122, filed on May 22, 2020; said PCT/US2020/034122, filed on May 22, 2020, claims priority, under 35 U.S.C. § 119(e), from U.S. Provisional Patent Application, Ser. No. 62/851,583, filed on May 22, 2019; said PCT Patent Application Number PCT/US2019/057210, filed on Oct. 21, 2019 claims priority, under 35 U.S.C. § 119(e), from U.S. Provisional Patent Application, Ser. No. 62/915,729, filed on Oct. 16, 2019; said PCT Patent Application Number PCT/US2019/057210, filed on Oct. 21, 2019 claims priority, under 35 U.S.C. § 119(e), from U.S. Provisional Patent Application, Ser. No. 62/980,352, filed on Feb. 23, 2020; said PCT Patent Application Number PCT/US2019/057210, filed on Oct. 21, 2019 claims priority, under 35 U.S.C. § 119(e), from U.S. Provisional Patent Application, Ser. No. 62/980,371, filed on Feb. 23, 2020. The entire content of PCT/US2020/034122, filed on May 22, 2020, is hereby incorporated by reference.

The present application claims priority, under 35 U.S.C. § 119(e), from U.S. Provisional Patent Application, Ser. No. 62/851,583, filed on May 22, 2019. The entire content of U.S. Provisional Patent Application, Ser. No. 62/851,586, filed on May 22, 2019, is hereby incorporated by reference.

The present application claims priority, under 35 U.S.C. § 119(e), from U.S. Provisional Patent Application, Ser. No. 62/915,729, filed on Oct. 16, 2019. The entire content of U.S. Provisional Patent Application, Ser. No. 62/915,729, filed on Oct. 16, 2019, is hereby incorporated by reference.

The present application claims priority, under 35 U.S.C. § 119(e), from U.S. Provisional Patent Application, Ser. No. 62/980,352, filed on Feb. 23, 2020. The entire content of U.S. Provisional Patent Application, Ser. No. 62/980,352, filed on Feb. 23, 2020, is hereby incorporated by reference.

The present application claims priority, under 35 U.S.C. § 119(e), from U.S. Provisional Patent Application, Ser. No. 62/980,371, filed on Feb. 23, 2020. The entire content of U.S. Provisional Patent Application, Ser. No. 62/980,371, filed on Feb. 23, 2020, is hereby incorporated by reference.

BACKGROUND

Conventional piles are metal tubes having either a circular or a rectangular cross-section. Such piles are mounted in the ground to provide a support structure for the construction of superstructures. The piles are provided in sections that are driven into the ground.

An example of a conventional pile is illustrated in FIG. 1. More specifically, FIG. 1 is a schematic view of one embodiment of an auger grouted displacement pile.

As illustrated in FIG. 1, an auger grouted displacement pile 100 includes an elongated, tubular pipe 102 with a hollow central chamber, a top section 104 and a bottom section 106. Bottom section 106 includes a soil (medium) displacement head 108. Top section 104 includes a reverse auger 110. Soil (medium) displacement head 108 has a cutting blade 112 that has a leading edge 114 and a trailing edge 116.

The leading edge 114 of cutting blade 112 cuts into the soil (medium) as the pile is rotated and loosens the soil (medium) at such contact point. The soil (medium) displacement head 108 may be equipped with a point 118 to promote this cutting.

The loosened soil (medium) passes over cutting blade 112 and thereafter past trailing edge 116. The auger grouted displacement pile 100 also includes a deformation structure 120 that cuts into or gouges the wall of the annulus or bore created by the displacement head 108, so as to create a deformation in the wall of the annulus or bore. The deformation in the wall of the annulus or bore assists in preventing shearing between the grout and the soil (medium).

It is noted that some conventional piles have a cutting tip that permits them to be rapidly deployed. By rotating the pile, the blade pulls the pile into the ground (medium), thus greatly reducing the amount of downward force necessary to bury the pile. Unfortunately, the rotary action of the pile also loosens the soil which holds the pile in place. This reduces the amount of vertical support the pile provides.

Conventionally, grout is injected around the pile in an attempt to solidify the volume around the pile and thus compensate for the loose soil. In addition, to providing grout to the area around the pile, the grout, to be effective, needs to be able to grip or have a frictional contact with the pile to prevent any slippage between the grout and the pile, thereby strengthening the vertical support the pile provides.

Therefore, it is desirable to provide a pile that is configured or shaped to provide gripping or frictional contact with the grout to prevent any slippage between the grout and the pile, thereby strengthening the vertical support the pile provides.

Also, it is desirable to provide a pile that is configured or shaped to resist grout from shearing along its surface.

BRIEF DESCRIPTION OF THE DRAWINGS

The drawings are only for purposes of illustrating various embodiments and are not to be construed as limiting, wherein.

DETAILED DESCRIPTION

Figure 1:
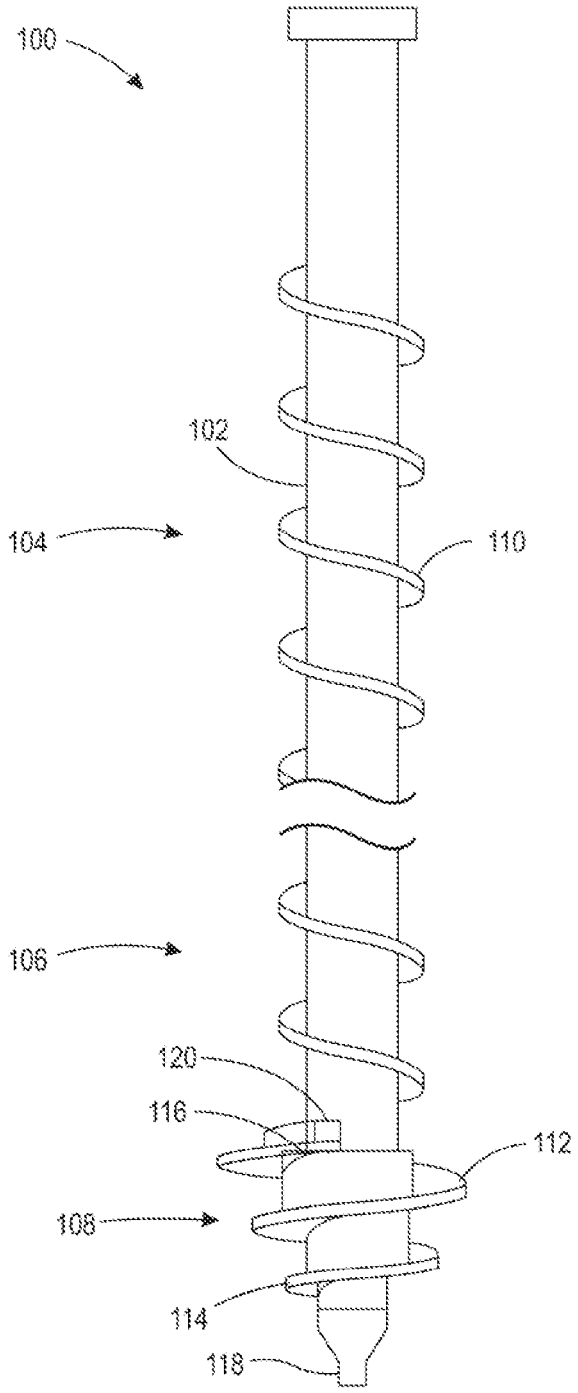
FIG. 1 illustrates a conventional pile.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 2:
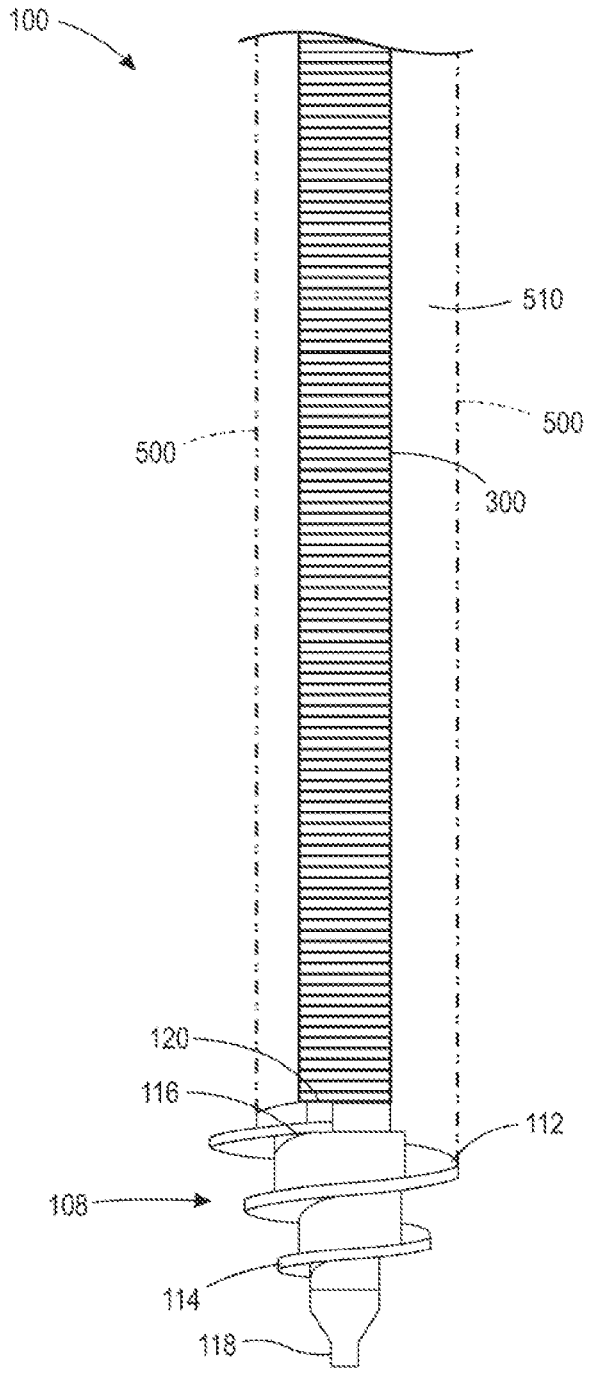
FIG. 2 illustrates an example of a deformed pile for providing gripping contact with grout and resisting grout from shearing.

An example of a pile for providing gripping contact with grout and resisting grout from shearing is illustrated in FIG. 2. More specifically, FIG. 2 is a schematic view of one embodiment of a deformed displacement pile.

As illustrated in FIG. 2, a deformed displacement pile 100 is an elongated, tubular pipe with a hollow central chamber having threads 300 on the outer surface. A bottom section of the deformed displacement pile 100 includes a soil (medium) displacement head 108. Soil (medium) displacement head 108 has a cutting blade 112 that has a leading edge 114 and a trailing edge 116.

The leading edge 114 of cutting blade 112 cuts into the soil (medium) as the deformed displacement pile 100 is rotated and loosens the soil (medium) at such contact point. The soil (medium) displacement head 108 may be equipped with a point 118 to promote this cutting.

The loosened soil (medium) passes over cutting blade 112 and thereafter past trailing edge 116. As the loosened soil medium passes over cutting blade 112 and thereafter past trailing edge 116, the soil (medium) is laterally compacted by lateral compaction elements (discussed in more detail below). The lateral compaction elements create an annulus having outer wall 500 and void 510.

The deformed displacement pile 100 also includes a deformation structure 120 that cuts into or gouges the outer wall 500 of the annulus or bore created by the displacement head 108, so as to create a deformation in the outer wall 500 of the annulus or bore or a spiral groove in the outer wall 500 of the annulus or bore. The deformation in the outer wall 500 of the annulus or bore assists in preventing shearing between the grout and the soil (medium).

After the deformed displacement pile 100 is driven into position, grout (not shown) is introduced into the void 510 of the annulus. The grout can be introduced by means of gravity or pressure into the void 510 of the annulus.

Additionally, since the deformed displacement pile 100 is a hollow tube, the grout can be introduced into the void 510 of the annulus through the hollow tube by means of gravity or pressure, wherein the deformed displacement pile 100 would include openings (not shown) that allows the grout to leave the pile and enter into the void 510 of the annulus.

The introduced grout surrounds the threads 300 of the deformed displacement pile 100 to provide gripping interface between the grout and the deformed displacement pile 100, as well as, providing an interface that resists the grout from shearing along the surface between the grout and the deformed displacement pile 100.

Figure 3:
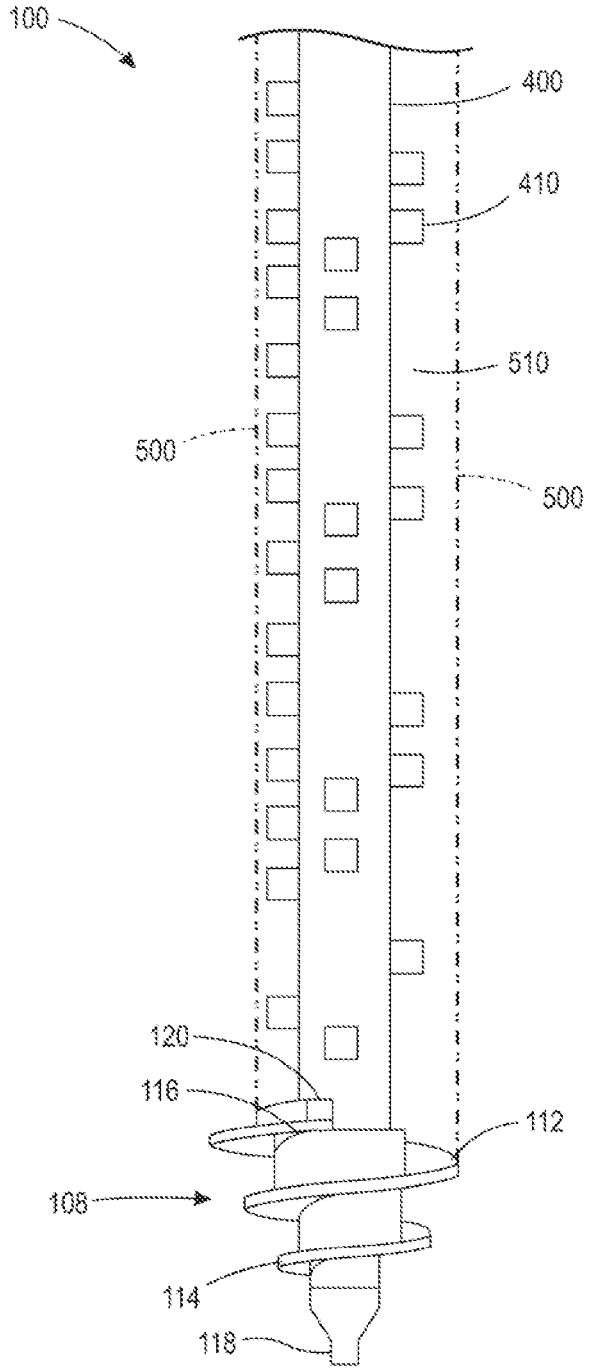
FIG. 3 illustrates another example of a deformed pile for providing gripping contact with grout and resisting grout from shearing.

Another example of a pile for providing gripping contact with grout and resisting grout from shearing is illustrated in FIG. 3. More specifically, FIG. 3 is a schematic view of one embodiment of a deformed displacement pile.

As illustrated in FIG. 3, a deformed displacement pile 100 is an elongated, tubular pipe 400 with a hollow central chamber having projections 410 on the outer surface. The projections 410 may be randomly placed on the outer surface of the deformed displacement pile 100 or be placed in a pattern. The projections 410 extend out from the outer surface of the deformed displacement pile 100 into the void 510 of an annulus without coming into contact with an outer wall 500 of the annulus.

A bottom section of the deformed displacement pile 100 includes a soil (medium) displacement head 108. Soil (medium) displacement head 108 has a cutting blade 112 that has a leading edge 114 and a trailing edge 116.

The leading edge 114 of cutting blade 112 cuts into the soil (medium) as the deformed displacement pile 100 is rotated and loosens the soil (medium) at such contact point. The soil (medium) displacement head 108 may be equipped with a point 118 to promote this cutting.

The loosened soil (medium) passes over cutting blade 112 and thereafter past trailing edge 116. As the loosened soil medium passes over cutting blade 112 and thereafter past trailing edge 116, the soil (medium) is laterally compacted by lateral compaction elements (discussed in more detail below). The lateral compaction elements create an annulus having outer wall 500 and void 510.

The deformed displacement pile 100 also includes a deformation structure 120 that cuts into or gouges the outer wall 500 of the annulus or bore created by the displacement head 108, so as to create a deformation in the outer wall 500 of the annulus or bore or a spiral groove in the outer wall 500 of the annulus or bore. The deformation in the outer wall 500 of the annulus or bore assists in preventing shearing between the grout and the soil (medium).

After the deformed displacement pile 100 is driven into position, grout (not shown) is introduced into the void 510 of the annulus. The grout can be introduced by means of gravity or pressure into the void 510 of the annulus.

Additionally, since the deformed displacement pile 100 is a hollow tube, the grout can be introduced into the void 510 of the annulus through the hollow tube by means of gravity or pressure, wherein the deformed displacement pile 100 would include openings (not shown) that allows the grout to leave the pile and enter into the void 510 of the annulus.

The introduced grout surrounds the projections 410 of the deformed displacement pile 100 to provide gripping interface between the grout and the deformed displacement pile 100, as well as, providing an interface that resists the grout from shearing along the surface between the grout and the deformed displacement pile 100.

Figure 4:
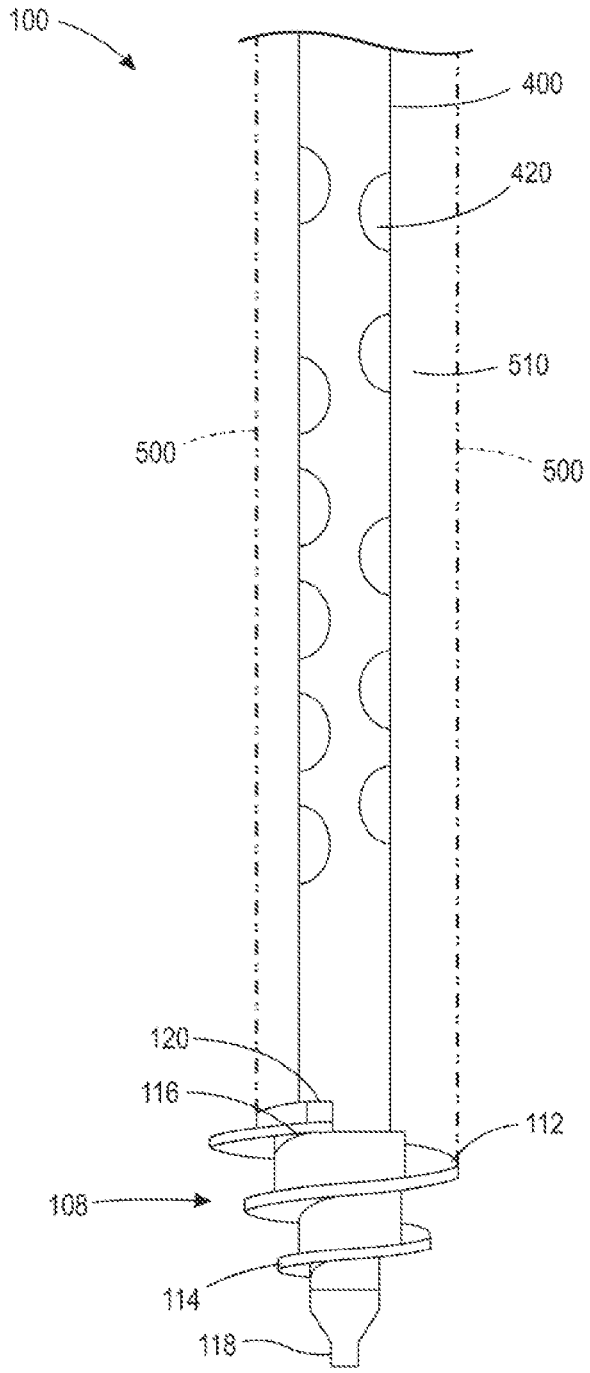
FIG. 4 illustrates a third example of a deformed pile for providing gripping contact with grout and resisting grout from shearing.

A third example of a pile for providing gripping contact with grout and resisting grout from shearing is illustrated in FIG. 4. More specifically, FIG. 4 is a schematic view of one embodiment of a deformed displacement pile.

As illustrated in FIG. 4, a deformed displacement pile 100 is an elongated, tubular pipe 400 with a hollow central chamber having indentations 420 on the outer surface. The indentations 420 may be randomly placed on the outer surface of the deformed displacement pile 100 or be placed in a pattern. The indentations 420 extend inwardly from the outer surface of the deformed displacement pile 100 away from the void 510 of an annulus.

A bottom section of the deformed displacement pile 100 includes a soil (medium) displacement head 108. Soil (medium) displacement head 108 has a cutting blade 112 that has a leading edge 114 and a trailing edge 116.

The leading edge 114 of cutting blade 112 cuts into the soil (medium) as the deformed displacement pile 100 is rotated and loosens the soil (medium) at such contact point. The soil (medium) displacement head 108 may be equipped with a point 118 to promote this cutting.

The loosened soil (medium) passes over cutting blade 112 and thereafter past trailing edge 116. As the loosened soil medium passes over cutting blade 112 and thereafter past trailing edge 116, the soil (medium) is laterally compacted by lateral compaction elements (discussed in more detail below). The lateral compaction elements create an annulus having outer wall 500 and void 510.

The deformed displacement pile 100 also includes a deformation structure 120 that cuts into or gouges the outer wall 500 of the annulus or bore created by the displacement head 108, so as to create a deformation in the outer wall 500 of the annulus or bore or a spiral groove in the outer wall 500 of the annulus or bore. The deformation in the outer wall 500 of the annulus or bore assists in preventing shearing between the grout and the soil (medium).

After the deformed displacement pile 100 is driven into position, grout (not shown) is introduced into the void 510 of the annulus. The grout can be introduced by means of gravity or pressure into the void 510 of the annulus.

Additionally, since the deformed displacement pile 100 is a hollow tube, the grout can be introduced into the void 510 of the annulus through the hollow tube by means of gravity or pressure, wherein the deformed displacement pile 100 would include openings (not shown) that allows the grout to leave the pile and enter into the void 510 of the annulus.

The introduced grout surrounds the indentations 420 of the deformed displacement pile 100 to provide gripping interface between the grout and the deformed displacement pile 100, as well as, providing an interface that resists the grout from shearing along the surface between the grout and the deformed displacement pile 100.

Figure 5:
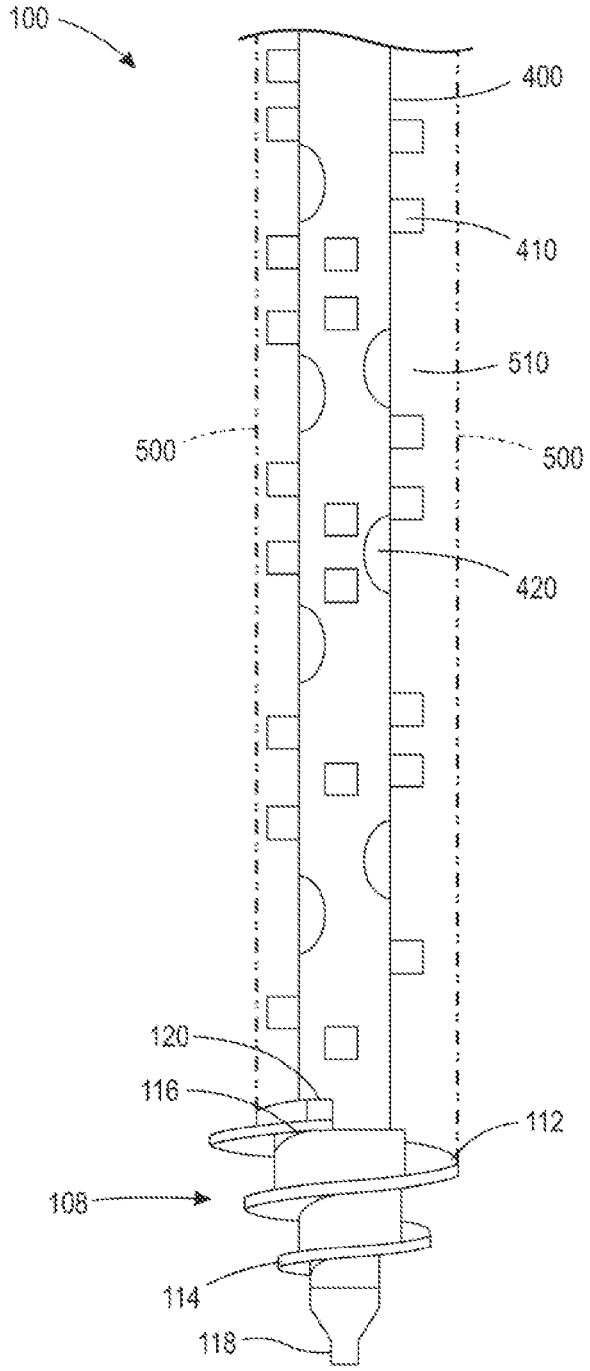
FIG. 5 illustrates a fourth example of a deformed pile for providing gripping contact with grout and resisting grout from shearing.

A fourth example of a pile for providing gripping contact with grout and resisting grout from shearing is illustrated in FIG. 5. More specifically, FIG. 5 is a schematic view of one embodiment of a deformed displacement pile.

As illustrated in FIG. 5, a deformed displacement pile 100 is an elongated, tubular pipe 400 with a hollow central chamber having indentations 420 and projections 410 on the outer surface. The indentations 420 and projections 410 may be randomly placed on the outer surface of the deformed displacement pile 100 or be placed in a pattern. The indentations 420 extend inwardly from the outer surface of the deformed displacement pile 100 away from the void 510 of an annulus, and the projections 410 extend out from the outer surface of the deformed displacement pile 100 into the void 510 of an annulus without coming into contact with an outer wall 500 of the annulus.

A bottom section of the deformed displacement pile 100 includes a soil (medium) displacement head 108. Soil (medium) displacement head 108 has a cutting blade 112 that has a leading edge 114 and a trailing edge 116.

The leading edge 114 of cutting blade 112 cuts into the soil (medium) as the deformed displacement pile 100 is rotated and loosens the soil (medium) at such contact point. The soil (medium) displacement head 108 may be equipped with a point 118 to promote this cutting.

The loosened soil (medium) passes over cutting blade 112 and thereafter past trailing edge 116. As the loosened soil medium passes over cutting blade 112 and thereafter past trailing edge 116, the soil (medium) is laterally compacted by lateral compaction elements (discussed in more detail below). The lateral compaction elements create an annulus having outer wall 500 and void 510.

The deformed displacement pile 100 also includes a deformation structure 120 that cuts into or gouges the outer wall 500 of the annulus or bore created by the displacement head 108, so as to create a deformation in the outer wall 500 of the annulus or bore or a spiral groove in the outer wall 500 of the annulus or bore. The deformation in the outer wall 500 of the annulus or bore assists in preventing shearing between the grout and the soil (medium).

After the deformed displacement pile 100 is driven into position, grout (not shown) is introduced into the void 510 of the annulus. The grout can be introduced by means of gravity or pressure into the void 510 of the annulus.

Additionally, since the deformed displacement pile 100 is a hollow tube, the grout can be introduced into the void 510 of the annulus through the hollow tube by means of gravity or pressure, wherein the deformed displacement pile 100 would include openings (not shown) that allows the grout to leave the pile and enter into the void 510 of the annulus.

The introduced grout surrounds the indentations 420 and projections 410 of the deformed displacement pile 100 to provide gripping interface between the grout and the deformed displacement pile 100, as well as, providing an interface that resists the grout from shearing along the surface between the grout and the deformed displacement pile 100.

Figure 6:
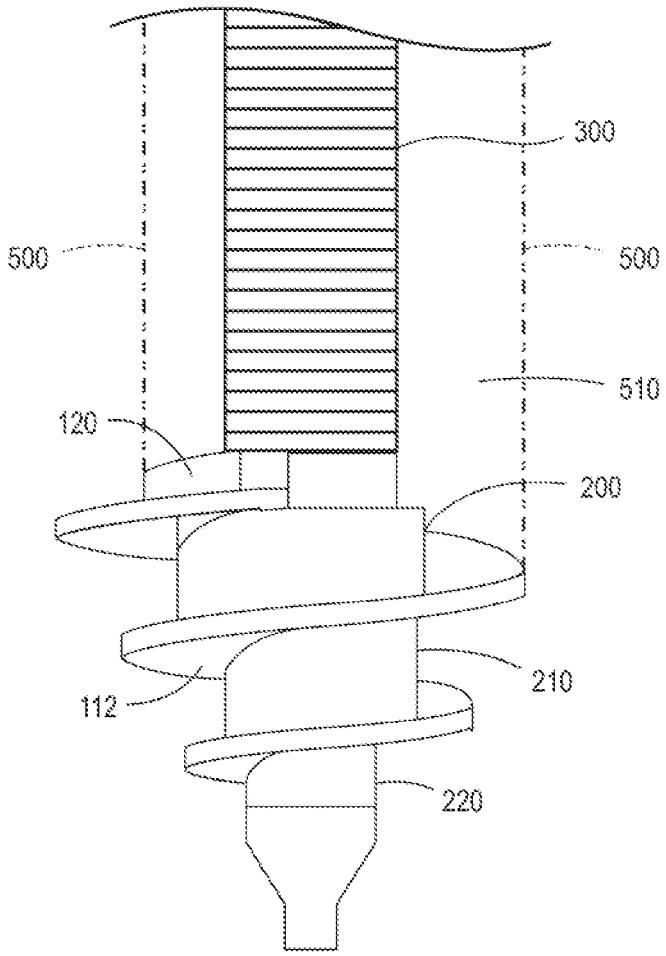
FIGS. 6 and 7 illustrate a bottom section of the pile of FIG. 2.
Figure 7:
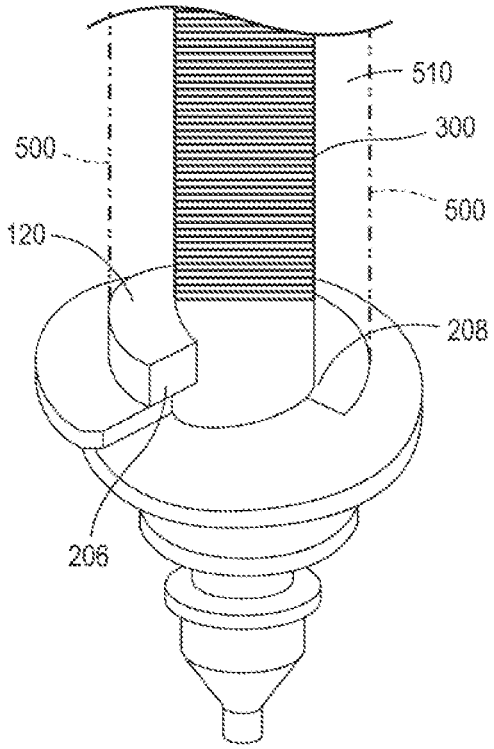

FIGS. 6 and 7 are side and perspective views of the bottom section of the deformed displacement pile of FIG. 2. The bottom section includes at least one lateral compaction element. In the embodiment shown in FIGS. 6 and 7, there are three such lateral compaction elements. The lateral compaction element 220 near the end of the deformed displacement pile has a diameter less than the diameter from the lateral compaction element 200 near deformation structure 120. The lateral compaction element 210 in the middle has a diameter that is between the diameters of the other two lateral compaction elements. In this fashion, the soil is laterally compacted by the first lateral compaction element 220, more compacted by the second lateral compaction element 210 (enlarging the diameter of the bored hole) and even more compacted by the third lateral compaction element 200.

The cutting blade 112 primarily cuts into the soil and only performs minimal soil compaction. The deformation structure 120 is disposed above the lateral compaction elements 200. After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 7, the deformation structure 120 has a height that changes over the length of the deformation structure 120 from its greatest height at end 206 to a lesser height at end 208 as the deformation structure 120 coils about the deformed displacement pile in a helical configuration.

Figure 8:
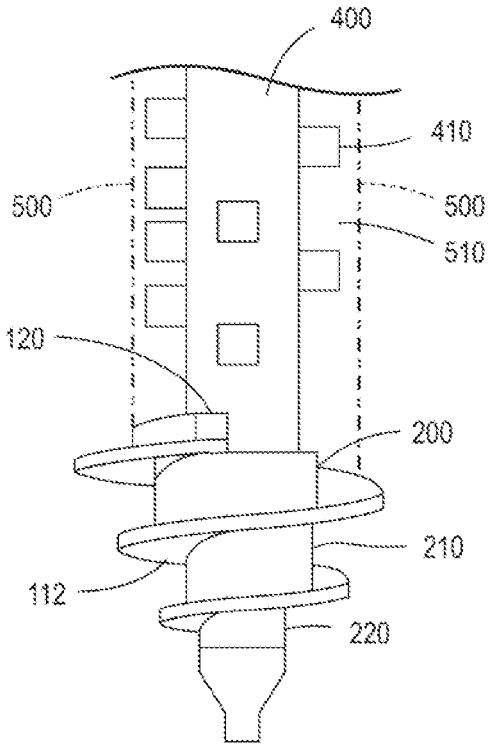
FIGS. 8 and 9 illustrate a bottom section of the pile of FIG. 3.
Figure 9:
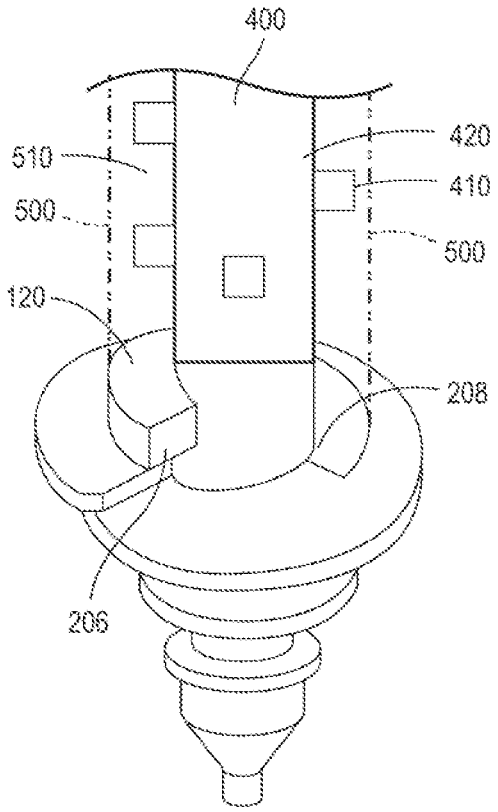

FIGS. 8 and 9 are side and perspective views of the bottom section of the deformed displacement pile of FIG. 3. The bottom section includes at least one lateral compaction element. In the embodiment shown in FIGS. 8 and 9, there are three such lateral compaction elements. The lateral compaction element 220 near the end of the deformed displacement pile has a diameter less than the diameter from the lateral compaction element 200 near deformation structure 120.

The lateral compaction element 210 in the middle has a diameter that is between the diameters of the other two lateral compaction elements. In this fashion, the soil is laterally compacted by the first lateral compaction element 220, more compacted by the second lateral compaction element 210 (enlarging the diameter of the bored hole) and even more compacted by the third lateral compaction element 200.

The cutting blade 112 primarily cuts into the soil and only performs minimal soil compaction. The deformation structure 120 is disposed above the lateral compaction elements 200. After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 9, the deformation structure 120 has a height that changes over the length of the deformation structure 120 from its greatest height at end 206 to a lesser height at end 208 as the deformation structure 120 coils about the deformed displacement pile in a helical configuration.

Figure 10:
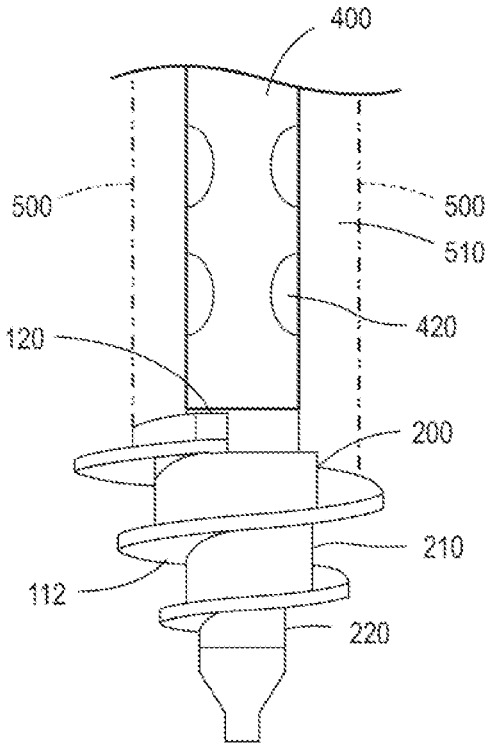
FIGS. 10 and 11 illustrate a bottom section of the pile of FIG. 4.
Figure 11:
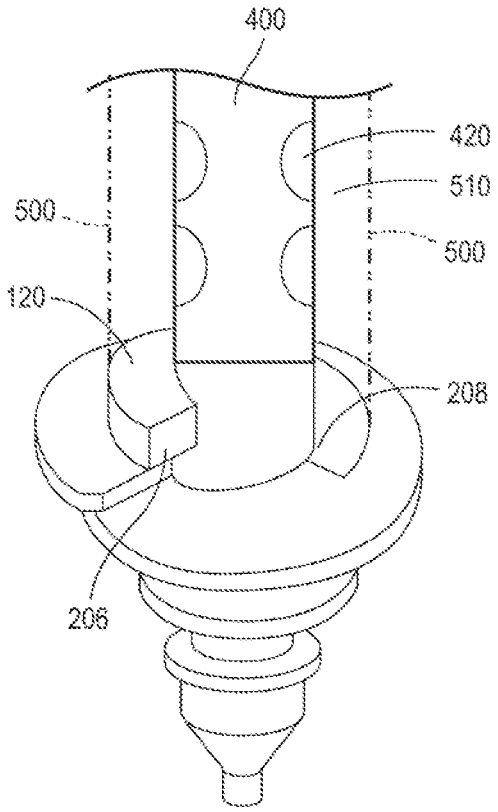

FIGS. 10 and 11 are side and perspective views of the bottom section of the deformed displacement pile of FIG. 4. The bottom section includes at least one lateral compaction element. In the embodiment shown in FIGS. 10 and 11, there are three such lateral compaction elements. The lateral compaction element 220 near the end of the deformed displacement pile has a diameter less than the diameter from the lateral compaction element 200 near deformation structure 120.

The lateral compaction element 210 in the middle has a diameter that is between the diameters of the other two lateral compaction elements. In this fashion, the soil is laterally compacted by the first lateral compaction element 220, more compacted by the second lateral compaction element 210 (enlarging the diameter of the bored hole) and even more compacted by the third lateral compaction element 200.

The cutting blade 112 primarily cuts into the soil and only performs minimal soil compaction. The deformation structure 120 is disposed above the lateral compaction elements 200. After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 11, the deformation structure 120 has a height that changes over the length of the deformation structure 120 from its greatest height at end 206 to a lesser height at end 208 as the deformation structure 120 coils about the deformed displacement pile in a helical configuration.

Figure 12:
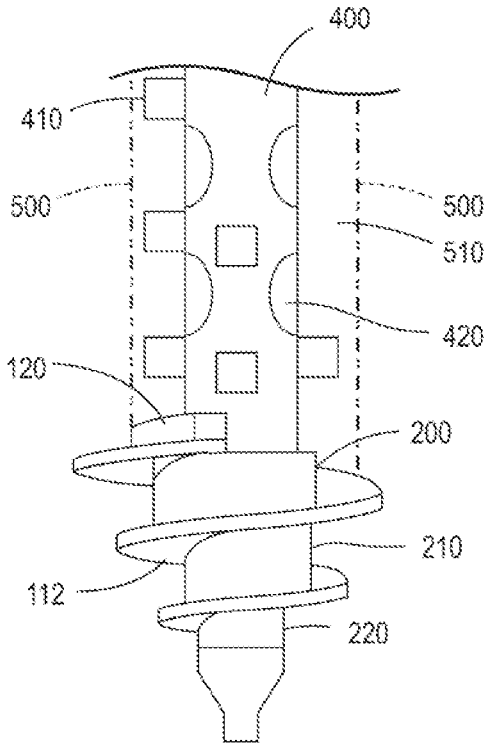
FIGS. 12 and 13 illustrate a bottom section of the pile of FIG. 5.
Figure 13:
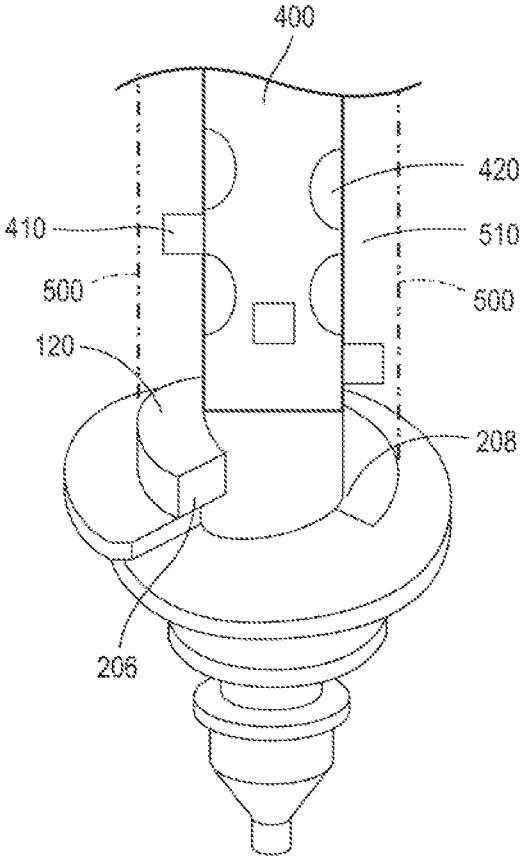

FIGS. 12 and 13 are side and perspective views of the bottom section of the deformed displacement pile of FIG. 5. The bottom section includes at least one lateral compaction element. In the embodiment shown in FIGS. 12 and 13, there are three such lateral compaction elements. The lateral compaction element 220 near the end of the deformed displacement pile has a diameter less than the diameter from the lateral compaction element 200 near deformation structure 120. The lateral compaction element 210 in the middle has a diameter that is between the diameters of the other two lateral compaction elements. In this fashion, the soil is laterally compacted by the first lateral compaction element 220, more compacted by the second lateral compaction element 210 (enlarging the diameter of the bored hole) and even more compacted by the third lateral compaction element 200.

The cutting blade 112 primarily cuts into the soil and only performs minimal soil compaction. The deformation structure 120 is disposed above the lateral compaction elements 200.

After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 13, the deformation structure 120 has a height that changes over the length of the deformation structure 120 from its greatest height at end 206 to a lesser height at end 208 as the deformation structure 120 coils about the deformed displacement pile in a helical configuration.

Figure 14:
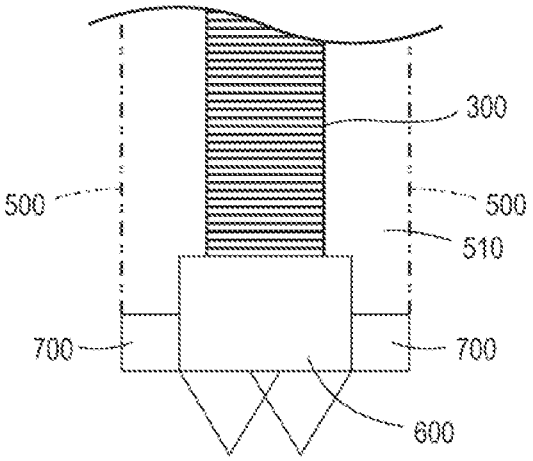
FIG. 14 illustrates another example of bottom section of the pile of FIG. 2.

FIG. 14 illustrates another example of a bottom section of the deformed displacement pile of FIG. 2. As illustrated in FIG. 14, the deformed displacement pile includes threads 300 on the outer surface of the deformed displacement pile.

The bottom section of the deformed displacement pile also includes a soil (medium) loosen bit or head 600 to loosen the soil (medium) around the deformed displacement pile as the deformed displacement pile is driven therein. The soil (medium) loosen bit or head 600 includes a lateral compaction structure 700 to laterally compact the loosen soil (medium) to create an annulus with an outer wall 500 and a void 510.

Figure 15:
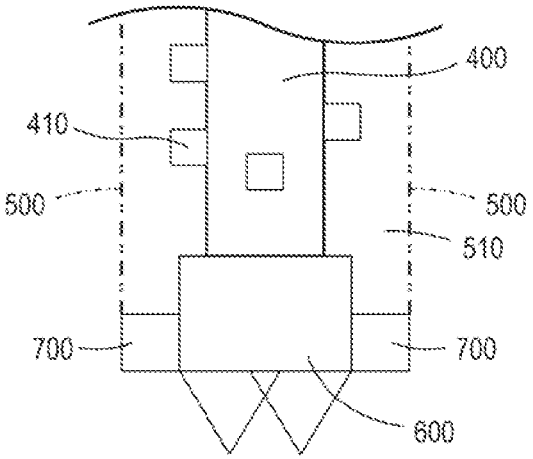
FIG. 15 illustrates another example of bottom section of the pile of FIG. 3.

FIG. 15 illustrates another example of a bottom section of the deformed displacement pile of FIG. 3. As illustrated in FIG. 15, the deformed displacement pile includes threads 300 on the outer surface of the deformed displacement pile.

The bottom section of the deformed displacement pile also includes a soil (medium) loosen bit or head 600 to loosen the soil (medium) around the deformed displacement pile as the deformed displacement pile is driven therein. The soil (medium) loosen bit or head 600 includes a lateral compaction structure 700 to laterally compact the loosen soil (medium) to create an annulus with an outer wall 500 and a void 510.

Figure 16:
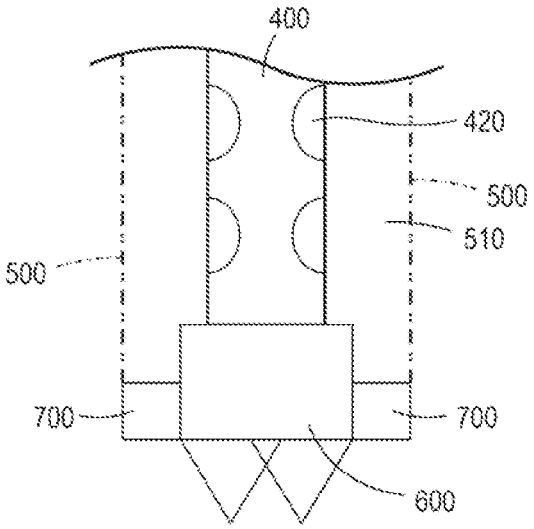
FIG. 16 illustrates another example of bottom section of the pile of FIG. 4.

FIG. 16 illustrates another example of a bottom section of the deformed displacement pile of FIG. 4. As illustrated in FIG. 16, the deformed displacement pile includes threads 300 on the outer surface of the deformed displacement pile.

The bottom section of the deformed displacement pile also includes a soil (medium) loosen bit or head 600 to loosen the soil (medium) around the deformed displacement pile as the deformed displacement pile is driven therein. The soil (medium) loosen bit or head 600 includes a lateral compaction structure 700 to laterally compact the loosen soil (medium) to create an annulus with an outer wall 500 and a void 510.

Large pipe shaped piles to be driven into the ground are difficult to handle and move to the vertical position to install. Conventionally, to couple handle large pipe shaped piles with the driver, the heavy drive equipment is turned near horizontal and a coupler type section is slid over the end. This conventional coupling process is difficult and requires alignment radially with the drive machine. The conventional coupling process often jambs and pinches during this operation.

Figure 17:
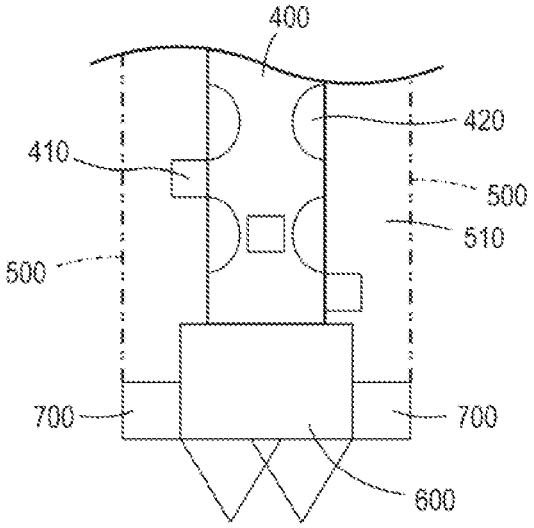
FIG. 17 illustrates another example of bottom section of the pile of FIG. 5.

FIG. 17 illustrates another example of a bottom section of the deformed displacement pile of FIG. 5. As illustrated in FIG. 17, the deformed displacement pile includes threads 300 on the outer surface of the deformed displacement pile.

The bottom section of the deformed displacement pile also includes a soil (medium) loosen bit or head 600 to loosen the soil (medium) around the deformed displacement pile as the deformed displacement pile is driven therein. The soil (medium) loosen bit or head 600 includes a lateral compaction structure 700 to laterally compact the loosen soil (medium) to create an annulus with an outer wall 500 and a void 510.

Figure 18:
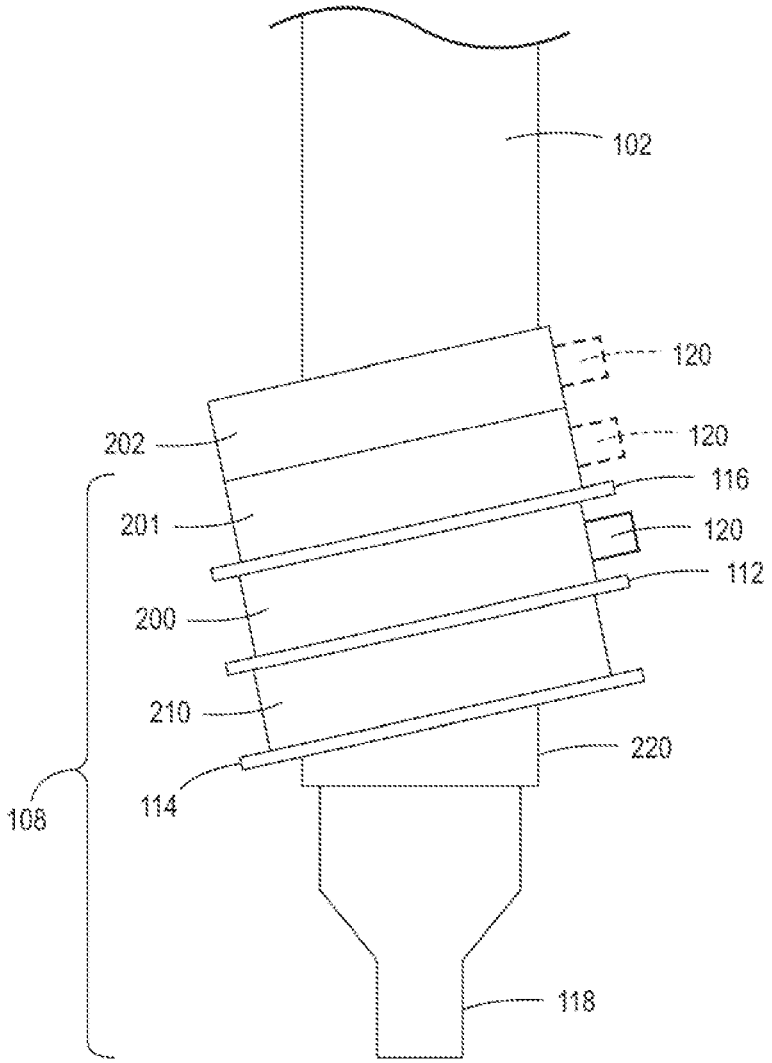
FIG. 18 illustrates an example of bottom section of a pile wherein the lateral compaction element extends up the pile shaft beyond the cutting blade.

FIG. 18 illustrates an example of bottom section of a displacement pile wherein the lateral compaction element extends up the pile shaft beyond the cutting blade. As illustrated in FIG. 18, the soil (medium) displacement head 108 is connected to an elongated, tubular pipe 102 with a hollow central chamber. A top section of the elongated, tubular pipe 102 may include a reverse auger (not shown) and/or the top section of the elongated, tubular pipe 102 may include indentations (not shown) and/or projections (not shown) to provide a gripping interface between grout introduced into an annulus produced by the displacement pile and the displacement pile, as well as, providing an interface that resists the grout from shearing along the surface between the grout and the displacement pile.

The soil (medium) displacement head 108 also includes a cutting blade 112 that has a leading edge 114 and a trailing edge 116.

The leading edge 114 of cutting blade 112 cuts into the soil (medium) as the displacement pile is rotated and loosens the soil (medium) at such contact point. The soil (medium) displacement head 108 may be equipped with a point 118 to promote this cutting.

The loosened soil (medium) passes over cutting blade 112 and thereafter past trailing edge 116.

The soil (medium) displacement head 108 includes at least one lateral compaction element. In the embodiment shown in FIG. 18, there are at least three lateral compaction elements. The lateral compaction element 220 has a diameter less than the diameter of the lateral compaction element 200. The lateral compaction element 210 has a diameter that is between the diameters of the lateral compaction element 220 and the lateral compaction element 200. In this fashion, the soil is laterally compacted by the first lateral compaction element 220, more compacted by the second lateral compaction element 210 (enlarging the diameter of the bored hole) and even more compacted by the third lateral compaction element 200. The lateral compaction elements (220, 210, and 200), as the displacement head 108 is rotated into the soil (medium), laterally compacts the soil (medium) to create an annulus or bore.

As illustrated in FIG. 18, the lateral compaction element 200 includes, thereon, a deformation structure 120 that cuts into or gouges the wall of the annulus or bore created by lateral compaction elements (220, 210, and 200), so as to create a deformation in the wall of the annulus or bore. The deformation in the wall of the annulus or bore assists in preventing shearing between the grout and the soil (medium).

In this embodiment, as further illustrated in FIG. 18, the annulus or bore created by the lateral compaction is maintained beyond the trailing edge 116 of the cutting blade 112. As illustrated in FIG. 18, a first lateral retention element 201 and a second lateral retention element 202 extend beyond the trailing edge 116 of the cutting blade 112. The first lateral retention element 201 and the second lateral retention element 202 have the same diameter as the lateral compaction element 200. The lateral retention elements assist in preventing a portion of the annulus, above the trailing edge 116 of the cutting blade 112, from collapsing before the grout can be introduced into the annulus, thereby enabling an effectively filling of the annulus with grout.

It is noted that is preferred the lateral retention element or elements extend at least one rotation around the tube 102 beyond the trailing edge 116 of the cutting blade 112. However, any number or fraction thereof of rotations beyond the trailing edge 116 of the cutting blade 112 can be realized in preventing the annulus from collapsing before the grout can be introduced into the annulus, thereby enabling an effectively filling of the annulus with grout.

As illustrated in FIG. 18, the deformation structure 120 may be co-located with the lateral compaction element 200, or alternatively, the deformation structure 120 may be co-located with the first lateral retention element 201 or the second lateral retention element 202. Alternatively, the deformation structure 120 may be continuously co-located with the lateral compaction element 200, the first lateral retention element 201, and the second lateral retention element 202.

Although illustrated as separate lateral compaction elements, the first lateral compaction element extension 201 and/or the second lateral compaction element extension 202 may be a continuous lateral compaction element of lateral compaction element 200.

Although described in all the embodiments above as separate lateral compaction element, the lateral compaction element may be a continuous lateral compaction element.

Figure 33:
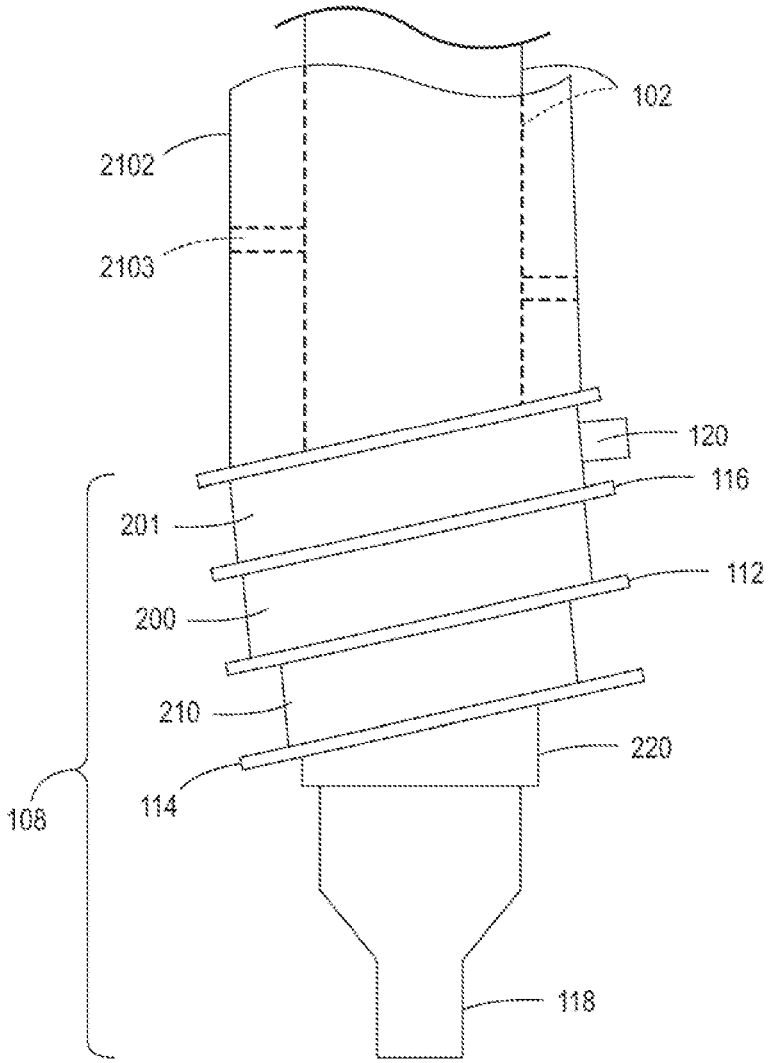
FIG. 33 illustrates an example of bottom section of a pile wherein a lateral compaction maintenance element extends up the pile shaft beyond the cutting blade.

FIG. 33 illustrates an example of bottom section of a displacement pile wherein a lateral compaction maintenance element extends up the pile shaft beyond the cutting blade. As illustrated in FIG. 33, the soil (medium) displacement head 108 is connected to an elongated, tubular pipe 102 with a hollow central chamber. A top section of the elongated, tubular pipe 102 may include a reverse auger (not shown) and/or the top section of the elongated, tubular pipe 102 may include indentations (not shown) and/or projections (not shown) to provide a gripping interface between grout introduced into an annulus produced by the displacement pile and the displacement pile, as well as, providing an interface that resists the grout from shearing along the surface between the grout and the displacement pile.

The soil (medium) displacement head 108 also includes a cutting blade 112 that has a leading edge 114 and a trailing edge 116.

The leading edge 114 of cutting blade 112 cuts into the soil (medium) as the displacement pile is rotated and loosens the soil (medium) at such contact point. The soil (medium) displacement head 108 may be equipped with a point 118 to promote this cutting. The loosened soil (medium) passes over cutting blade 112 and thereafter past trailing edge 116.

The soil (medium) displacement head 108 includes at least one lateral compaction element. In the embodiment shown in FIG. 33, there are at least four lateral compaction elements (220, 210, 200, 201). The lateral compaction element 220 has a diameter less than the diameter of the lateral compaction element 200. The lateral compaction element 210 has a diameter that is between the diameters of the lateral compaction element 220 and the lateral compaction element 200. The lateral compaction element 201 may have a diameter greater than a diameter of the lateral compaction element 200, or the lateral compaction element 201 may have a diameter equal to the diameter of the lateral compaction element 200. In this fashion, the soil is laterally compacted by the first lateral compaction element 220, more compacted by the second lateral compaction element 210 (enlarging the diameter of the bored hole) and even more compacted by the third lateral compaction element 200, and if the lateral compaction element 201 has a diameter greater than a diameter of the lateral compaction element 200, even more compacted by the fourth lateral compaction element 201.

The lateral compaction element 201 includes a deformation structure 120 that cuts into or gouges the wall of the annulus or bore created by lateral compaction elements (220, 210, 200, 201), so as to create a deformation in the wall of the annulus or bore. The deformation in the wall of the annulus or bore assists in preventing shearing between the grout and the soil (medium).

In this embodiment, as illustrated in FIG. 33, a lateral compaction maintenance element 2102 is positioned above the trailing edge 116 of the cutting blade 112 and the fourth lateral compaction element 201. As illustrated in FIG. 33, the lateral compaction maintenance element 2102 has the same diameter as the lateral compaction element 201. The lateral compaction maintenance element 2102 assists in preventing the annulus from collapsing before the grout can be introduced into the annulus, thereby enabling an effectively filling of the annulus with grout.

The lateral compaction maintenance element 2102 may be, as illustrated in FIG. 33, a hollow cylinder that is connected to the elongated, tubular pipe 102 via spacers 2103. The spacers 2103 may be constructed of a metal or metal alloy and welded to the elongated, tubular pipe 102 and the lateral compaction maintenance element 2102.

It is noted that the length or extension of the lateral compaction maintenance element 2102 may vary depending upon the nature of the medium (soil). If the medium (soil) is very loose, the length or extension of the lateral compaction maintenance element 2102 will be greater than the length or extension of the lateral compaction maintenance element 2102 when the medium (soil) is hard.

As illustrated in FIG. 33, the deformation structure 120 may be co-located with the lateral compaction element 201, or alternatively, the deformation structure 120 may be co-located with the lateral compaction maintenance element 2102. Alternatively, the deformation structure 120 may be continuously co-located with the lateral compaction element 201 and the lateral compaction maintenance element 2102.

Although described and illustrated as separate lateral compaction elements, the lateral compaction elements may be a continuous lateral compaction element.

It is noted that the lateral compaction maintenance element 2102 is located on the elongated, tubular pipe 102 above the cutting blade 112.

It is further noted that a bottom of the lateral compaction maintenance element 2102 is located in close proximity to the trailing edge 116 of the cutting blade 112 to prevent a collapse of the annulus formed by the lateral compaction element(s).

Figure 19:
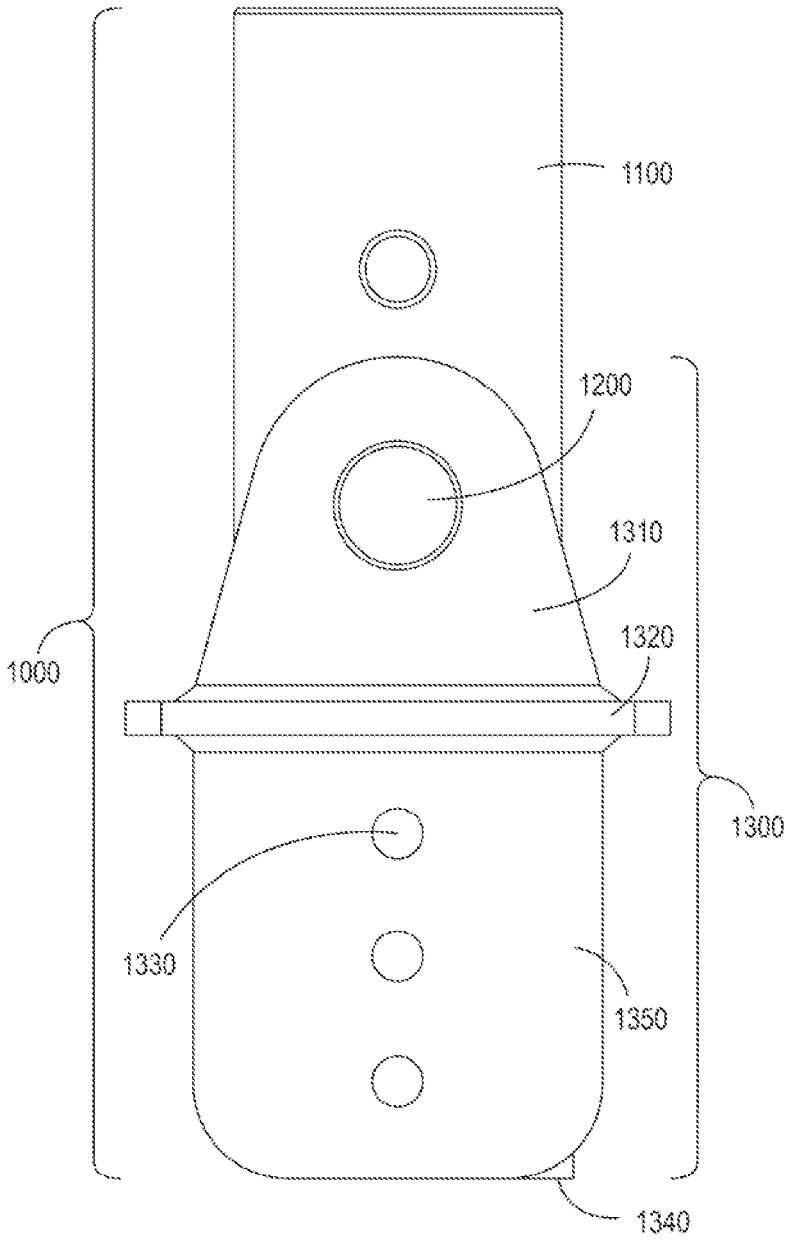
FIG. 19 illustrates a side view of a pile picking adapter with a swivel in a parallel position.

FIG. 19 illustrates a side view of a pile picking adapter with a swivel in a parallel position. As illustrated in FIG. 19, a pile picking adapter 1000 includes a driver coupling member 1100 to enable coupling of the pile picking adapter 1000 to a driving unit (not shown) that drives a pile. The pile picking adapter 1000 also includes a swivel 1200 and a pile coupling member 1300. The swivel 1200 allows the pile coupling member 1300 to swivel (rotate) with respect to the driver coupling member 1100. In one embodiment, the swivel 1200 provides a rotation of 180°.

The pile coupling member 1300 includes swivel engagement members 1310 that engage swivel 1200. The swivel engagement members 1310 are orthogonal to a pile backing stop plate 1320. The pile backing stop plate 1320 provides a stop to enable alignment of a pile (not shown) when attaching a pile to the pile picking adapter 1000.

The pile coupling member 1300 also includes pile wings 1350, which are orthogonal to the pile backing stop plate 1320. The pile wings 1350 include holes 1330 for enabling the bolting or riveting (attaching) of the pile coupling member 1300 to a pile.

Moreover, the pile coupling member 1300 also includes pile adapter 1340, which a curved surface for engaging the pile and providing alignment when attaching a pile to the pile picking adapter 1000.

Figure 20:
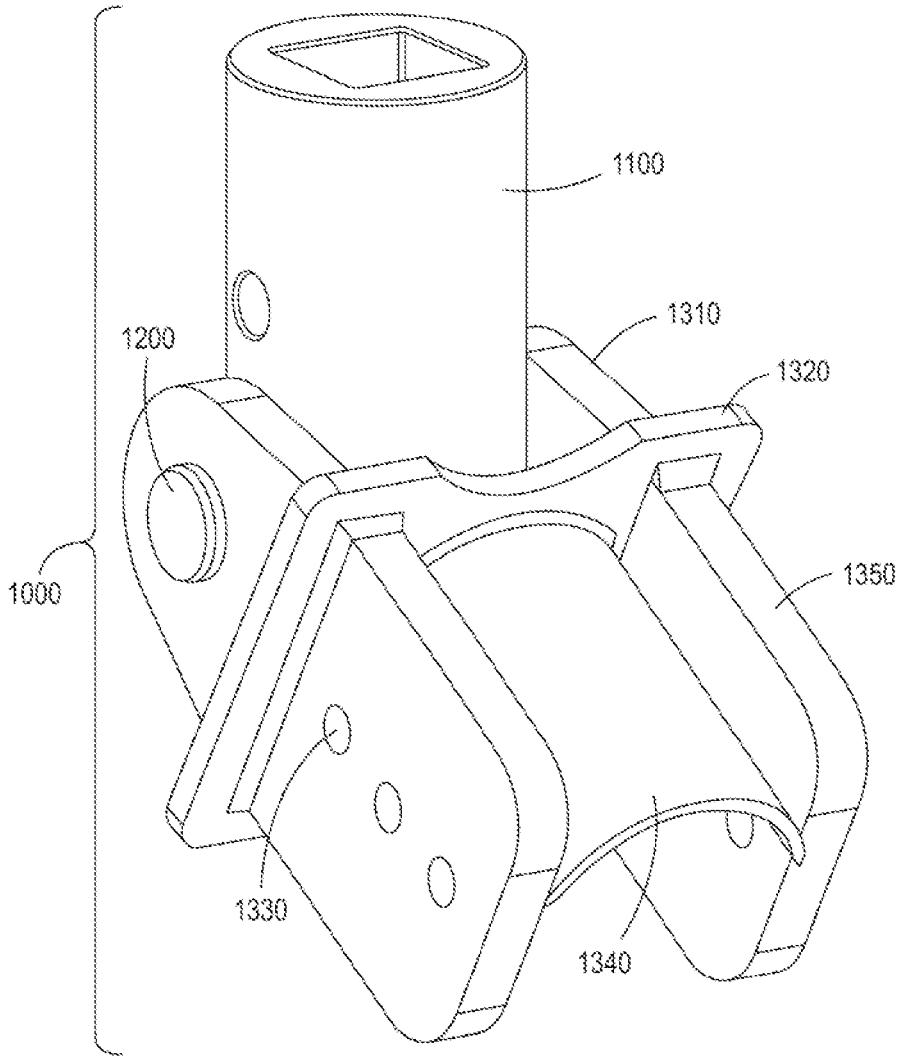
FIG. 20 illustrates a side view of a pile picking adapter with a swivel in a 45° position.

FIG. 20 illustrates a side view of a pile picking adapter with a swivel in a 45° position. As illustrated in FIG. 20, a pile picking adapter 1000 includes a driver coupling member 1100 to enable coupling of the pile picking adapter 1000 to a driving unit (not shown) that drives a pile. The pile picking adapter 1000 also includes a swivel 1200 and a pile coupling member. The swivel 1200 allows the pile coupling member 1300 to swivel (rotate) with respect to the driver coupling member 1100. In one embodiment, the swivel 1200 provides a rotation of 180°.

The pile coupling member includes swivel engagement members 1310 that engage swivel 1200. The swivel engagement members 1310 are orthogonal to a pile backing stop plate 1320. The pile backing stop plate 1320 provides a stop to enable alignment of a pile (not shown) when attaching a pile to the pile picking adapter 1000.

The pile coupling member also includes pile wings 1350, which are orthogonal to the pile backing stop plate 1320. The pile wings 1350 include holes 1330 for enabling the bolting or riveting (attaching) of the pile coupling member 1300 to a pile.

Moreover, the pile coupling member also includes pile adapter 1340, which a curved surface for engaging the pile and providing alignment when attaching a pile to the pile picking adapter 1000.

Figure 21:
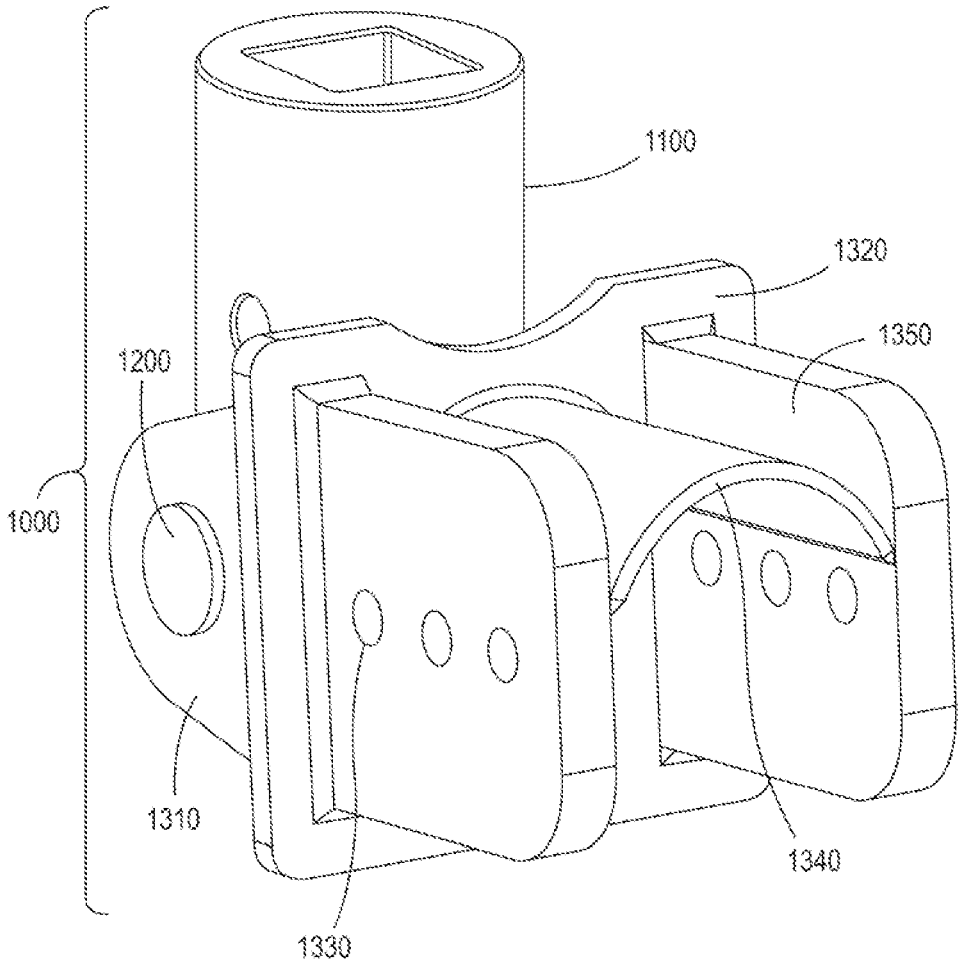
FIG. 21 illustrates a side view of a pile picking adapter with a swivel in an orthogonal position.

FIG. 21 illustrates a side view of a pile picking adapter with a swivel in an orthogonal position. As illustrated in FIG. 21, a pile picking adapter 1000 includes a driver coupling member 1100 to enable coupling of the pile picking adapter 1000 to a driving unit (not shown) that drives a pile. The pile picking adapter 1000 also includes a swivel 1200 and a pile coupling member. The swivel 1200 allows the pile coupling member 1300 to swivel (rotate) with respect to the driver coupling member 1100. In one embodiment, the swivel 1200 provides a rotation of 180°.

The pile coupling member includes swivel engagement members 1310 that engage swivel 1200. The swivel engagement members 1310 are orthogonal to a pile backing stop plate 1320. The pile backing stop plate 1320 provides a stop to enable alignment of a pile (not shown) when attaching a pile to the pile picking adapter 1000.

The pile coupling member also includes pile wings 1350, which are orthogonal to the pile backing stop plate 1320. The pile wings 1350 include holes 1330 for enabling the bolting or riveting (attaching) of the pile coupling member 1300 to a pile.

Moreover, the pile coupling member also includes pile adapter 1340, which a curved surface for engaging the pile and providing alignment when attaching a pile to the pile picking adapter 1000.

Figure 22:
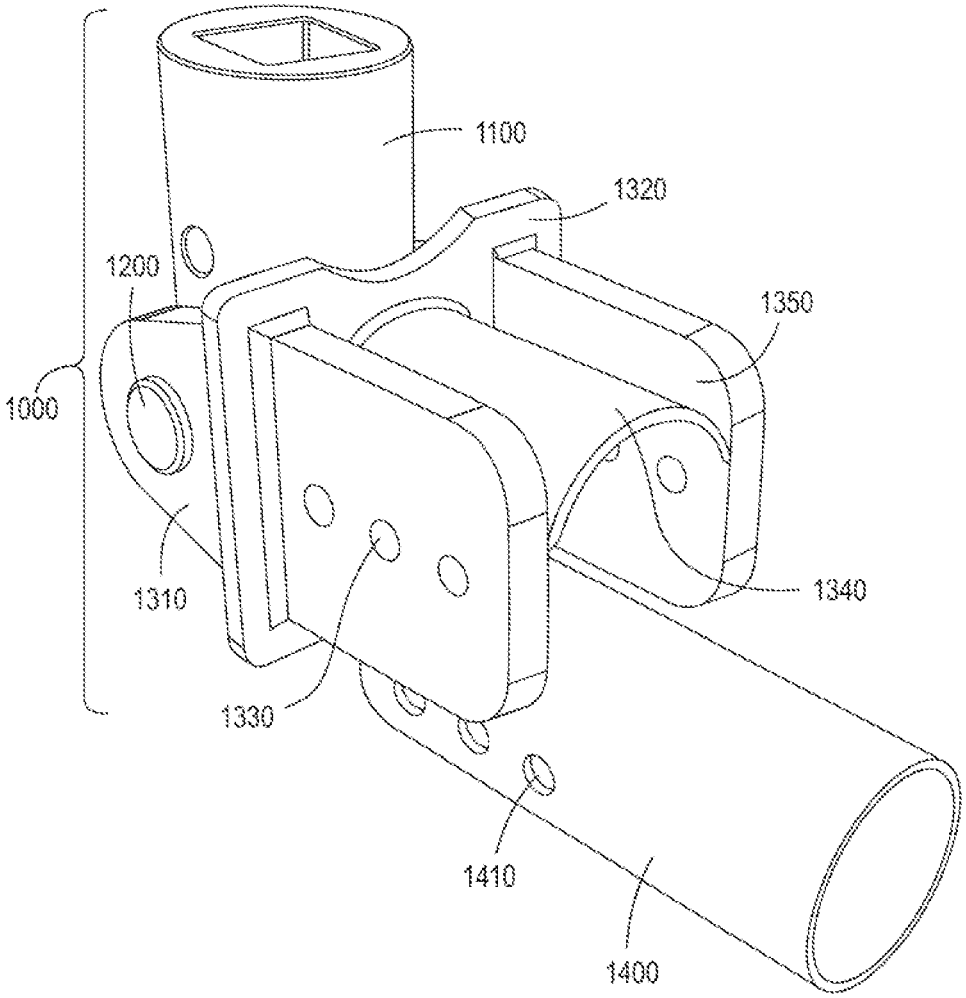
FIG. 22 illustrates a side view of a pile picking adapter engaging a pile with a swivel in an orthogonal position.

FIG. 22 illustrates a side view of a pile picking adapter engaging a pile with a swivel in an orthogonal position. As illustrated in FIG. 22, a pile picking adapter 1000 includes a driver coupling member 1100 to enable coupling of the pile picking adapter 1000 to a driving unit (not shown) that drives a pile 1400. The pile picking adapter 1000 also includes a swivel 1200 and a pile coupling member. The swivel 1200 allows the pile coupling member 1300 to swivel (rotate) with respect to the driver coupling member 1100. In one embodiment, the swivel 1200 provides a rotation of 180°.

The pile coupling member includes swivel engagement members 1310 that engage swivel 1200. The swivel engagement members 1310 are orthogonal to a pile backing stop plate 1320. The pile backing stop plate 1320 provides a stop to enable alignment of the pile 1400 when attaching a pile to the pile picking adapter 1000.

The pile coupling member also includes pile wings 1350, which are orthogonal to the pile backing stop plate 1320. The pile wings 1350 include holes 1330 for enabling the bolting or riveting (attaching) of the pile coupling member 1300 to the pile 1400. It is noted that pile 1400 includes holes 1410 for enabling the bolting or riveting (attaching) of the pile coupling member 1300 to the pile 1400.

Moreover, the pile coupling member also includes pile adapter 1340, which a curved surface for engaging the pile and providing alignment when attaching a pile to the pile picking adapter 1000.

Figure 23:
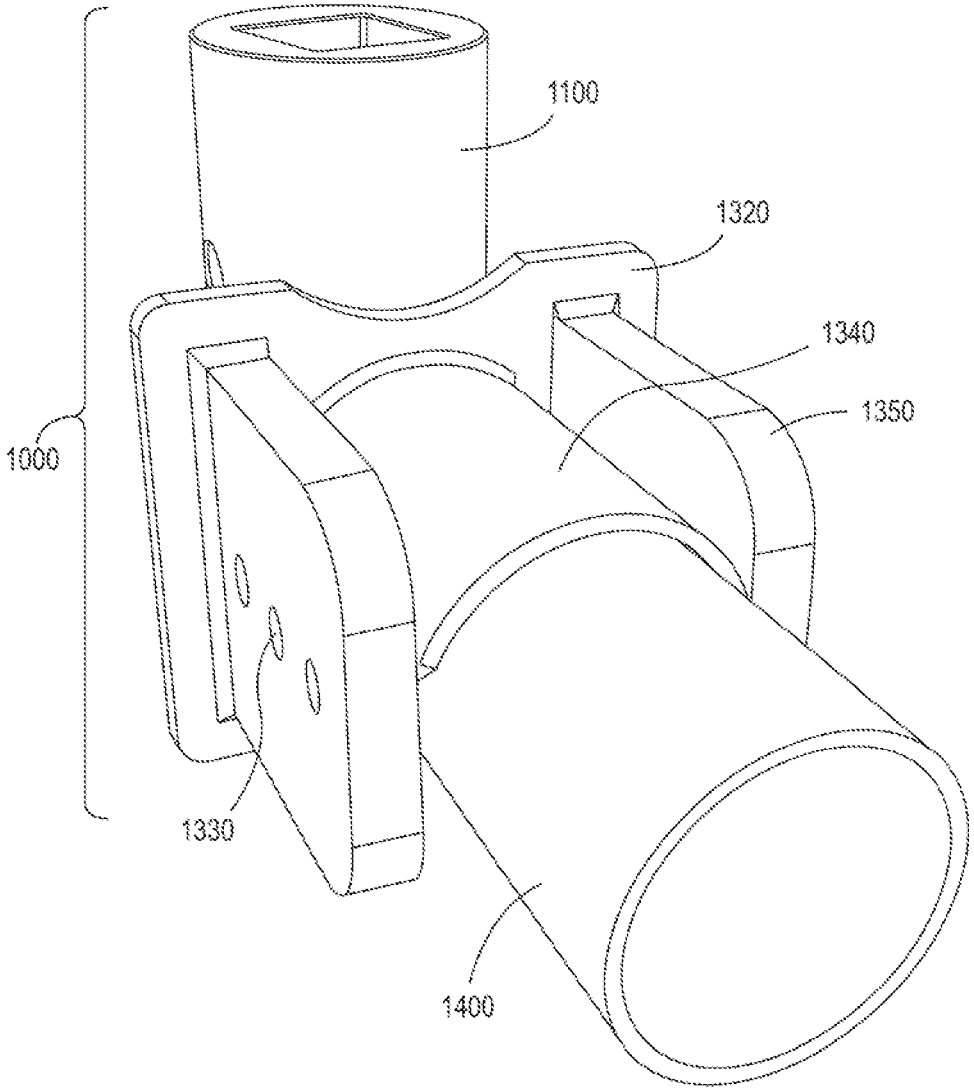
FIG. 23 illustrates a pile picking adapter engaged with a pile with a swivel in an orthogonal position.

FIG. 23 illustrates a pile picking adapter engaged with a pile with a swivel in an orthogonal position. As illustrated in FIG. 23, a pile picking adapter 1000 includes a driver coupling member 1100 to enable coupling of the pile picking adapter 1000 to a driving unit (not shown) that drives a pile 1400.

The pile picking adapter 1000 also includes a swivel 1200 and a pile coupling member. The swivel 1200 allows the pile coupling member 1300 to swivel (rotate) with respect to the driver coupling member 1100. In one embodiment, the swivel 1200 provides a rotation of 180°.

The pile coupling member includes swivel engagement members 1310 that engage swivel 1200. The swivel engagement members 1310 are orthogonal to a pile backing stop plate 1320. The pile backing stop plate 1320 provides a stop to enable alignment of the pile 1400 when attaching a pile to the pile picking adapter 1000.

The pile coupling member also includes pile wings 1350, which are orthogonal to the pile backing stop plate 1320. The pile wings 1350 include holes 1330 for enabling the bolting or riveting (attaching) of the pile coupling member 1300 to the pile 1400. It is noted that pile 1400 includes holes 1410 for enabling the bolting or riveting (attaching) of the pile coupling member 1300 to the pile 1400.

Moreover, the pile coupling member also includes pile adapter 1340, which a curved surface for engaging the pile and providing alignment when attaching a pile to the pile picking adapter 1000.

The above described pile picking adapter provides an effective means for coupling a large pile to a drive unit. More specifically, the pile picking adaptor enables attachment to a drive unit. The drive unit is able to be lowered over the pile at any angle radially to the machine having the drive unit attached thereto. The pile coupling member moving at the swivel to lay down over the pile attachment point and align to the pile attachment points. After being connected, the pile can be lifted to the drive position.

Figure 24:
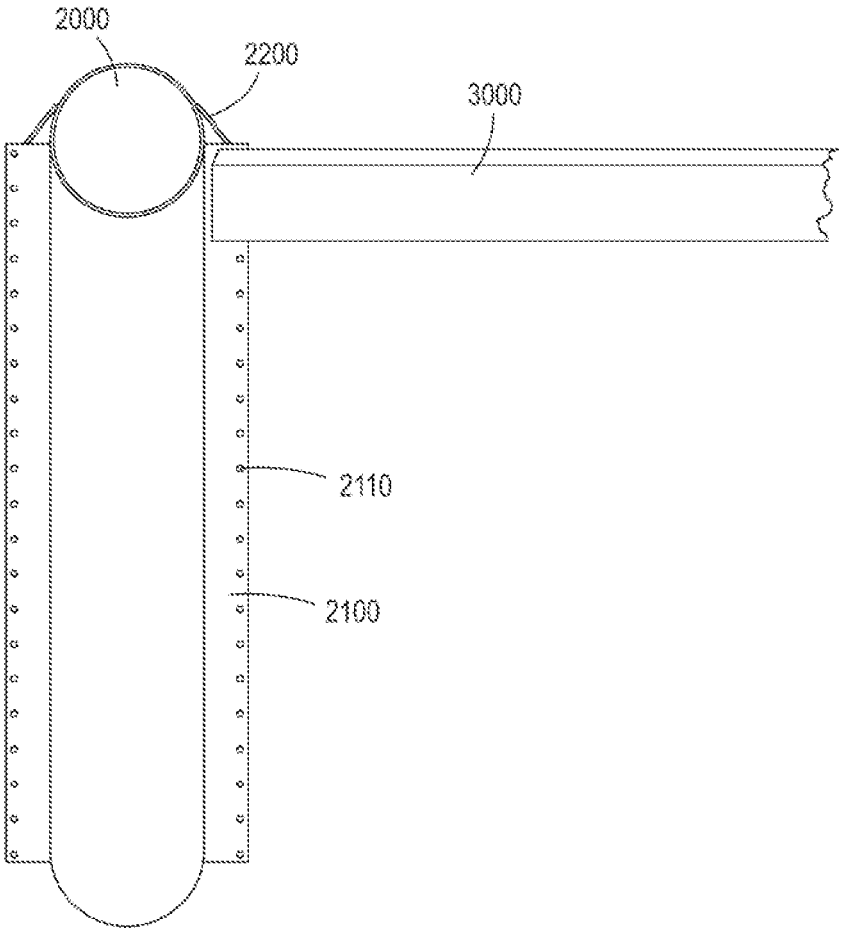
FIG. 24 illustrates a pile with a vertical flange for supporting excavation members.

FIG. 24 illustrates a pile with a vertical flange for supporting excavation members. As illustrated in FIG. 24, a pile 2000 includes vertical flange(s) 2100 for supporting excavation members 3000. The vertical flange(s) 2100 may be further attached to the pile 2000 by braces 2200. The vertical flange(s) 2100 includes holes 2110 for enabling the bolting or riveting (attaching) of the supporting excavation members 3000 to the pile 2000, via the vertical flange(s) 2100.

The vertical flange(s) 2100 are secured (attached) to the pile 2000 prior driving the pile 2000 into the ground or medium into which the pile 2000 is to be driven.

Moreover, the positioning of the vertical flange(s) 2100 on the pile 2000 is such that the vertical flange(s) 2100 do not interfere with the driving unit driving the pile 2000 into the ground or medium into which the pile 2000 is to be driven.

Preferably, the vertical flange(s) 2100 are secured (attached) to the pile 2000 when constructing the pile 2000. The vertical flange(s) 2100 may be welded to the pile 2000.

Figure 25:
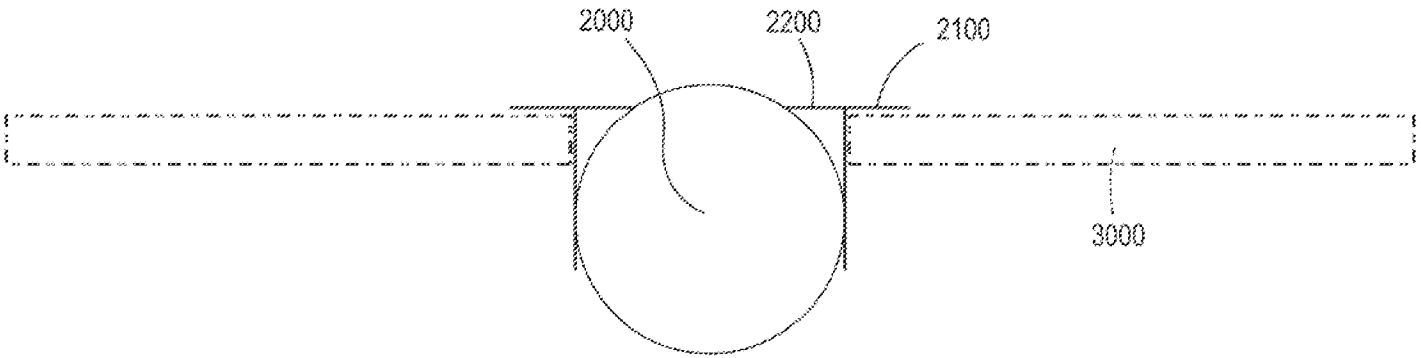
FIG. 25 illustrates a top view of a pile with a vertical flange for supporting excavation members.

FIG. 25 illustrates a top view of a pile with a vertical flange for supporting excavation members. As illustrated in FIG. 25, a pile 2000 includes vertical flange(s) 2100 for supporting excavation members 3000. The vertical flange(s) 2100 may be further attached to the pile 2000 by braces 2200. The vertical flange(s) 2100 include holes 2110 for enabling the bolting or riveting (attaching) of the supporting excavation members 3000 to the pile 2000, via the vertical flange(s) 2100.

The vertical flange(s) 2100 are secured (attached) to the pile 2000 prior driving the pile 2000 into the ground or medium into which the pile 2000 is to be driven. Moreover, the positioning of the vertical flange(s) 2100 on the pile 2000 is such that the vertical flange(s) 2100 do not interfere with the driving unit driving the pile 2000 into the ground or medium into which the pile 2000 is to be driven.

Preferably, the vertical flange(s) 2100 are secured (attached) to the pile 2000 when constructing the pile 2000. The vertical flange(s) 2100 may be welded to the pile 2000.

Figure 26:
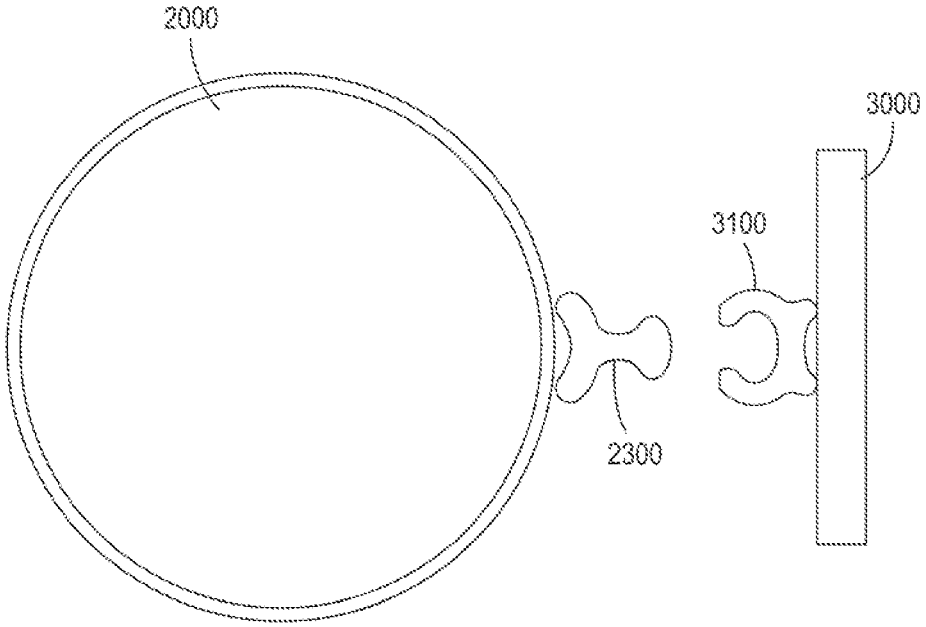
FIG. 26 illustrates a pile with a vertical coupling component for supporting excavation members having a mating vertical coupling component.

FIG. 26 illustrates a pile with a vertical coupling component for supporting excavation members having a mating vertical coupling component. As illustrated in FIG. 26, a pile 2000 includes a vertical coupling component 2300 for mating with a vertical coupling component 3100 of a supporting excavation member 3000.

The vertical coupling component 2300 is secured (attached) to the pile 2000 prior driving the pile 2000 into the ground or medium into which the pile 2000 is to be driven. Moreover, the positioning of the vertical coupling component 2300 on the pile 2000 is such that the vertical coupling component 2300 does not interfere with the driving unit driving the pile 2000 into the ground or medium into which the pile 2000 is to be driven.

Preferably, the vertical coupling component 2300 is secured (attached) to the pile 2000 when constructing the pile 2000. The vertical coupling component 2300 may be welded to the pile 2000.

Figure 27:
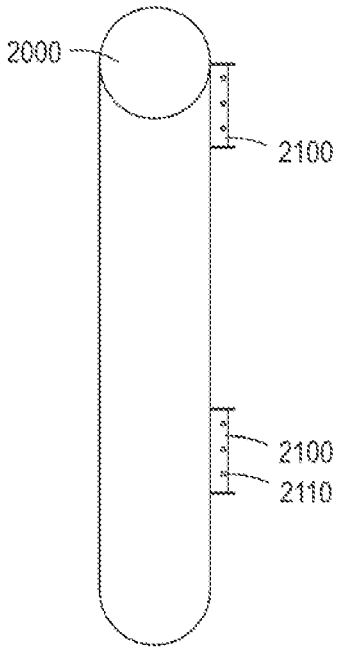
FIGS. 27 and 28 illustrate a pile with multiple vertical flanges for supporting excavation members.
Figure 28:
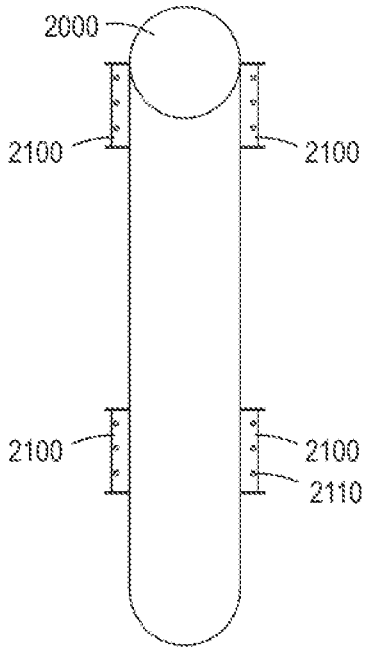

FIGS. 27 and 28 illustrate a pile with multiple vertical flanges for supporting excavation members. As illustrated in FIG. 27, a pile 2000 includes two vertical flanges 2100, located on one side of the pile 2000, for supporting excavation members 3000.

The vertical flanges 2100 may be further attached to the pile 2000 by braces (not shown). The vertical flanges 2100 include holes 2110 for enabling the bolting or riveting (attaching) of the supporting excavation members 3000 to the pile 2000, via the vertical flanges 2100.

The vertical flanges 2100 are secured (attached) to the pile 2000 prior driving the pile 2000 into the ground or medium into which the pile 2000 is to be driven. Moreover, the positioning of the vertical flanges 2100 on the pile 2000 is such that the vertical flanges 2100 do not interfere with the driving unit driving the pile 2000 into the ground or medium into which the pile 2000 is to be driven.

Preferably, the vertical flanges 2100 are secured (attached) to the pile 2000 when constructing the pile 2000. The vertical flanges 2100 may be welded to the pile 2000.

As illustrated in FIG. 28, a pile 2000 includes four vertical flanges 2100, tow located on one side of the pile 2000 and two located on an opposite side of the pile 2000, for supporting excavation members 3000.

The vertical flanges 2100 may be further attached to the pile 2000 by braces (not shown). The vertical flanges 2100 include holes 2110 for enabling the bolting or riveting (attaching) of the supporting excavation members 3000 to the pile 2000, via the vertical flanges 2100.

The vertical flanges 2100 are secured (attached) to the pile 2000 prior driving the pile 2000 into the ground or medium into which the pile 2000 is to be driven. Moreover, the positioning of the vertical flanges 2100 on the pile 2000 is such that the vertical flanges 2100 do not interfere with the driving unit driving the pile 2000 into the ground or medium into which the pile 2000 is to be driven.

Preferably, the vertical flanges 2100 are secured (attached) to the pile 2000 when constructing the pile 2000. The vertical flanges 2100 may be welded to the pile 2000.

Figure 29:
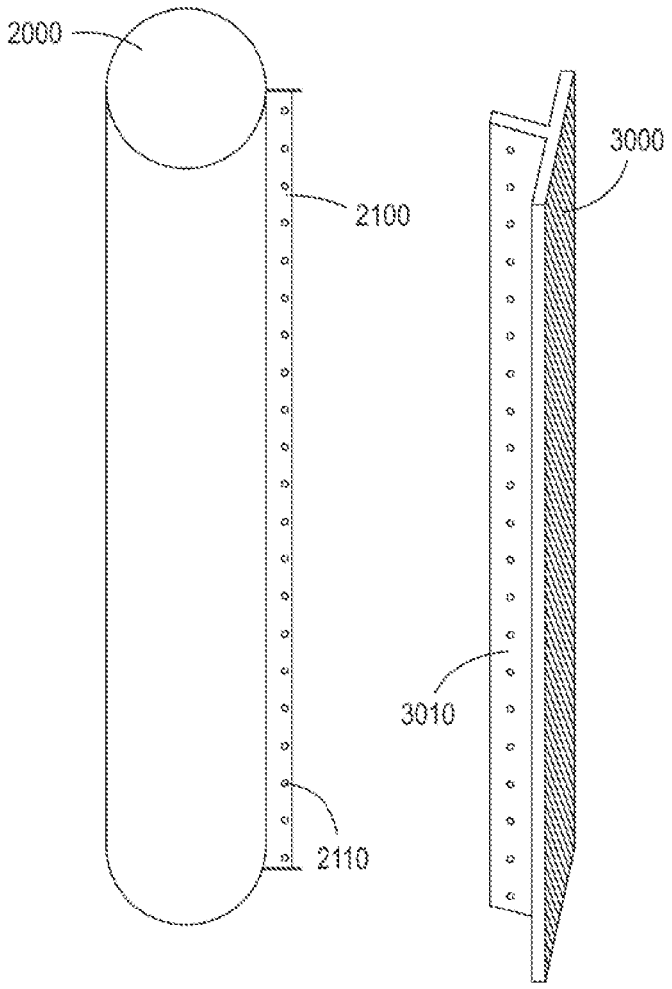
FIGS. 29 and 30 illustrate a pile with a vertical flange for supporting excavation member.
Figure 30:
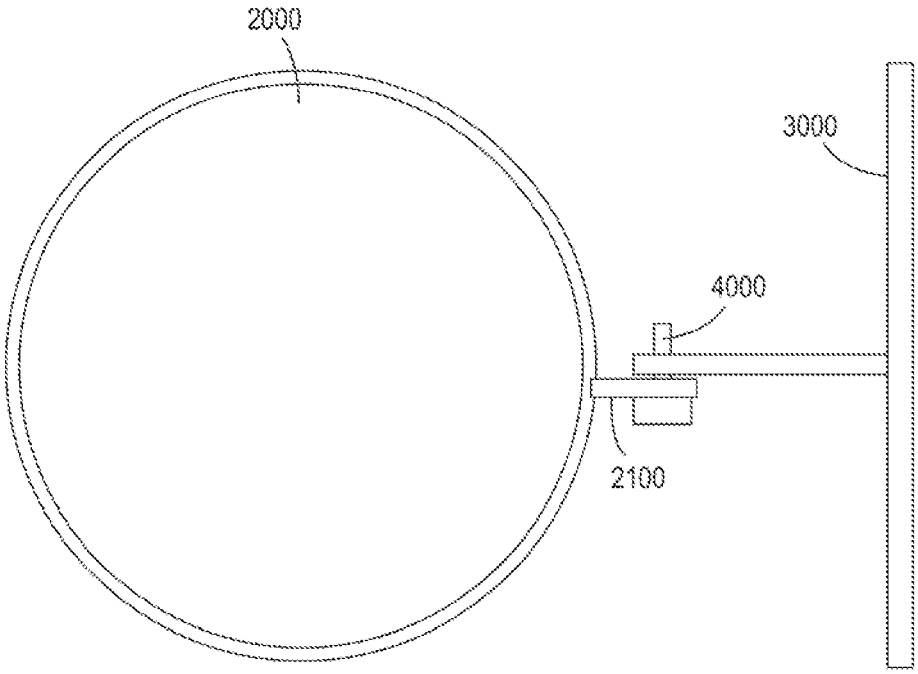

FIG. 29 and FIG. 30 illustrate a pile with a vertical flange for supporting excavation member. As illustrated in FIG. 29, a pile 2000 includes a vertical flange 2100 for supporting excavation members 3000. The vertical flange 2100 may be further attached to the pile 2000 by braces 2200. The vertical flange 2100 includes holes 2110 for enabling the bolting or riveting (attaching) of the supporting excavation members 3000 to the pile 2000, via the vertical flange 2100.

The vertical flange 2100 is secured (attached) to the pile 2000 prior driving the pile 2000 into the ground or medium into which the pile 2000 is to be driven. Moreover, the positioning of the vertical flange 2100 on the pile 2000 is such that the vertical flange 2100 does not interfere with the driving unit driving the pile 2000 into the ground or medium into which the pile 2000 is to be driven.

Preferably, the vertical flange 2100 is secured (attached) to the pile 2000 when constructing the pile 2000. The vertical flange 2100 may be welded to the pile 2000.

As illustrated in FIG. 30, a pile 2000 includes a vertical flange 2100 for supporting excavation members 3000. The vertical flange 2100 may be further attached to the pile 2000 by braces 2200. The vertical flange 2100 includes holes 2110 for enabling the bolting or riveting (attaching), via bolt or rivet 4000, of the supporting excavation members 3000 to the pile 2000, via the vertical flange 2100.

The vertical flange 2100 is secured (attached) to the pile 2000 prior driving the pile 2000 into the ground or medium into which the pile 2000 is to be driven. Moreover, the positioning of the vertical flange 2100 on the pile 2000 is such that the vertical flange 2100 does not interfere with the driving unit driving the pile 2000 into the ground or medium into which the pile 2000 is to be driven.

Preferably, the vertical flange 2100 is secured (attached) to the pile 2000 when constructing the pile 2000. The vertical flange 2100 may be welded to the pile 2000.

Figure 31:
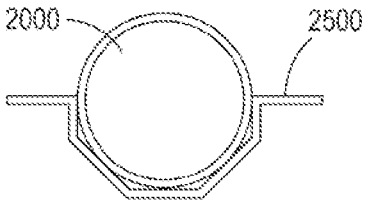
FIG. 31 illustrates a pile with a vertical flange for supporting excavation members.

FIG. 31 illustrates a pile with a vertical flange for supporting excavation members. As illustrated in FIG. 31, a pile 2000 includes a C-shaped vertical flange 2500 for supporting excavation members (not shown). The C-shaped vertical flange 2500 includes holes (not shown) for enabling the bolting or riveting (attaching of the supporting excavation members to the pile 2000, via the C-shaped vertical flange 2500.

The C-shaped vertical flange 2500 is secured (attached) to the pile 2000 prior driving the pile 2000 into the ground or medium into which the pile 2000 is to be driven.

Moreover, the positioning of the C-shaped vertical flange 2500 on the pile 2000 is such that the C-shaped vertical flange 2500 does not interfere with the driving unit driving the pile 2000 into the ground or medium into which the pile 2000 is to be driven.

Figure 32:
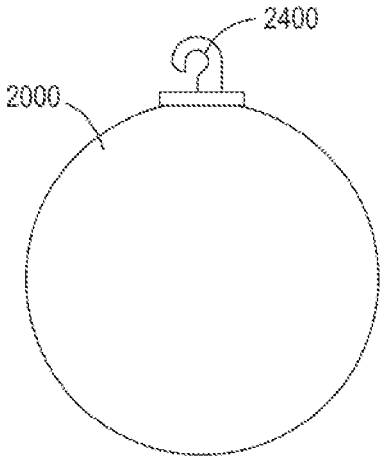
FIG. 32 illustrates a pile with a vertical coupling component for supporting excavation members.

FIG. 32 illustrates a pile with a vertical coupling component for supporting excavation members. As illustrated in FIG. 32, a pile 2000 includes a vertical hook-shaped coupling component 2400 for mating with a vertical coupling component of a supporting excavation member.

The vertical hook-shaped coupling component 2400 is secured (attached) to the pile 2000 prior driving the pile 2000 into the ground or medium into which the pile 2000 is to be driven. Moreover, the positioning of the vertical hook-shaped coupling component 2400 on the pile 2000 is such that the vertical hook-shaped coupling component 2400 does not interfere with the driving unit driving the pile 2000 into the ground or medium into which the pile 2000 is to be driven.

Preferably, the vertical hook-shaped coupling component 2400 is secured (attached) to the pile 2000 when constructing the pile 2000. The vertical hook-shaped coupling component 2400 may be welded to the pile 2000.

Figure 34:
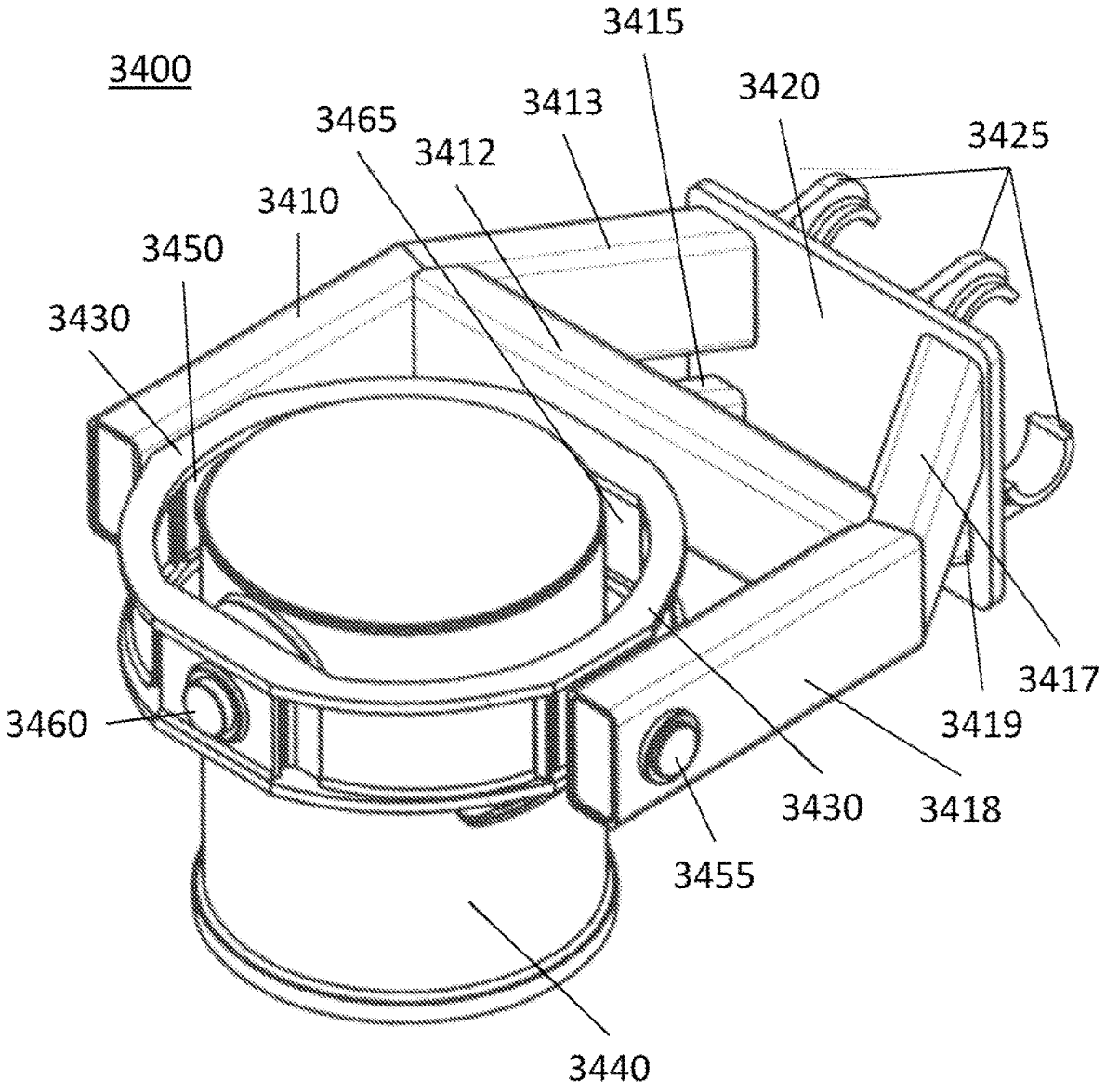
FIG. 34 illustrates a two-directional swing pile connector.

FIG. 34 illustrates a two-direction swing pile adapter 3400. The two-direction swing pile adapter 3400 includes a first ring 3430. The first ring 3430 is operatively connected to a first support arm 3410 via a first swivel connector 3450. The first ring 3430 is also operatively connected to a second support arm 3418 via a second swivel connector 3455. The first swivel connector 3450 is located opposite the second swivel connector 3455, with respect to the first ring 3430, such that a line from a center point of the first ring 3430 to the first swivel connector 3450 and a line from a center point of the first ring 3430 to the second swivel connector 3455 would form an angle substantially equal to 180°.

The two-direction swing pile adapter 3400 includes a first cylinder 3440 for engaging a pile (not shown). The first cylinder 3440 is operatively connected to the first ring 3430 via a third swivel connector 3460. The first cylinder 3440 is also operatively connected to the first ring 3430 via a fourth swivel connector 3465. The third swivel connector 3460 is located opposite the fourth swivel connector 3465, with respect to the first cylinder 3440, such that a line from a center point of the first cylinder 3440 to the third swivel connector 3460 and a line from a center point of the first cylinder 3440 to the fourth swivel connector 3465 would form an angle substantially equal to 180°.

It is noted that a line from a center point of the first cylinder 3440 to the third swivel connector 3460 and a line from a center point of the first cylinder 3440 to the second swivel connector 3455 would form an angle substantially equal to 90°.

It is noted that a line from a center point of the first cylinder 3440 to the fourth swivel connector 3465 and a line from a center point of the first cylinder 3440 to the second swivel connector 3455 would form an angle substantially equal to 90°.

It is noted that a line from a center point of the first cylinder 3440 to the fourth swivel connector 3465 and a line from a center point of the first cylinder 3440 to the first swivel connector 3450 would form an angle substantially equal to 90°.

It is noted that a line from a center point of the first cylinder 3440 to the third swivel connector 3460 and a line from a center point of the first cylinder 3440 to the first swivel connector 3450 would form an angle substantially equal to 90°.

A cross support bar 3412 is connected to the first support arm 3410 and the second support arm 3418. The two-direction swing pile adapter 3400 includes an attachment member 3420 having attachment mechanisms 3425 for coupling a pile to either a pile driver or supporting excavation members. The design and configuration of the attachment mechanisms 3425 would match the interface of the object that is being coupled to the pile.

The attachment member 3420 is connected to the cross support bar 3412 via a third support arm 3413, a fourth support arm 3415, a fifth support arm 3417, and a sixth support arm 3419.

The connections between the various support arms and the cross support bar and the attachment member may be welds.

In a preferred embodiment, the first swivel connector 3450 and the second swivel connector 3455 provide a minimum swing of 40° between the pile and the object that is being coupled to the pile.

Additionally, in a preferred embodiment, the third swivel connector 3450 and the fourth swivel connector 3455 provide a minimum swing of 20° between the pile and the object that is being coupled to the pile.

The swing provided by the first swivel connector 3450 and the second swivel connector 3455 is orthogonal to the swing provided by the third swivel connector 3450 and the fourth swivel connector 3455.

In other words, as illustrated in FIG. 34, the two-direction swing pile adapter 3400 provides a minimum swing of 40° in a first direction and a minimum swing of 20° in a second direction, wherein the first direction is orthogonal to the second direction.

More specifically, as illustrated in FIG. 34, the two-direction swing pile adapter 3400 provides a minimum swing of 40° in a direction orthogonal to the cross support bar 3412 and provides a minimum swing of 20° in a direction parallel to the cross support bar 3412.

The two-direction swing pile adapter 3400 provides two degrees of adaptability when attempting to couple a pile to supporting excavation members. The adaptability enhances the coupling process when the pile is not necessary driven straight into the medium. The degrees of freedom, provided by the two-direction swing pile adapter 3400, enable a coupling to a non-plumb pile and erecting plumb supporting excavation members.

The two-direction swing pile adapter 3400 provides two degrees of adaptability when attempting to couple a pile to pile driver. The adaptability enhances the coupling process when the pile driver cannot be positioned directly over the pile, thereby enabling driving the pile from different angles.

Figure 35:
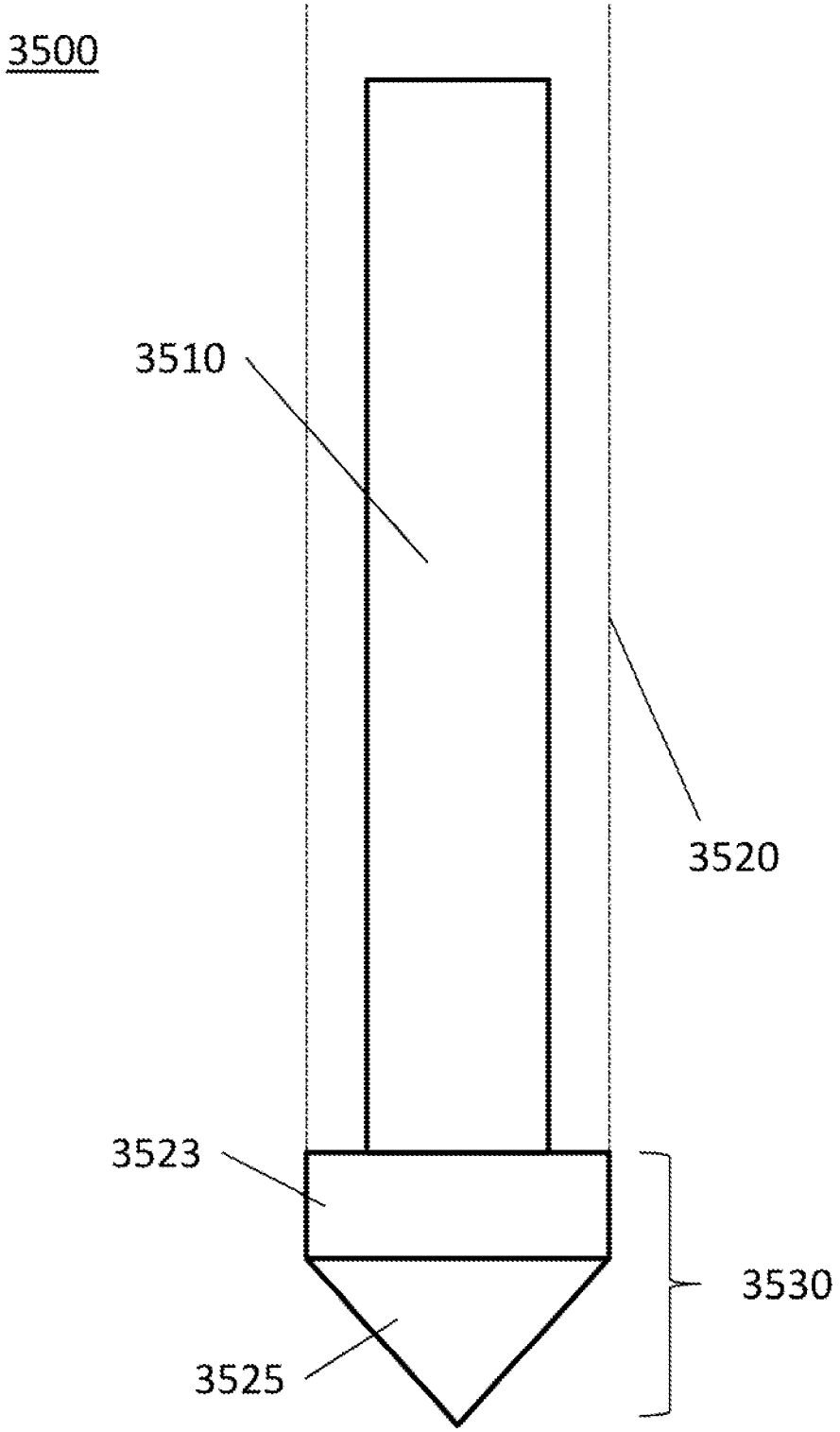
FIG. 35 illustrates a pound driven pile.

FIG. 35 illustrates a pound-driven pile 3500. A pound-driven pile is a pile that is driven into the medium (ground) solely by a pile driver that pounds (hammers) the pile. The pile driver applies no rotation to the pile as it is driven.

As illustrated in FIG. 35, the pound-driven pile 3500 includes a shaft 3510 and a displacement head 3530 that includes a head 3525 for transferring the force from the pounding to the medium to break up the medium and a lateral compaction member 3523 for laterally compacting the medium to create an annulus 3520 in the medium.

The shaft 3510 may be hollow to allow the introduction of grout into the annulus 3520. Moreover, the displacement head 3530 may include an opening to allow the introduction of grout into the annulus 3520.

Figure 36:
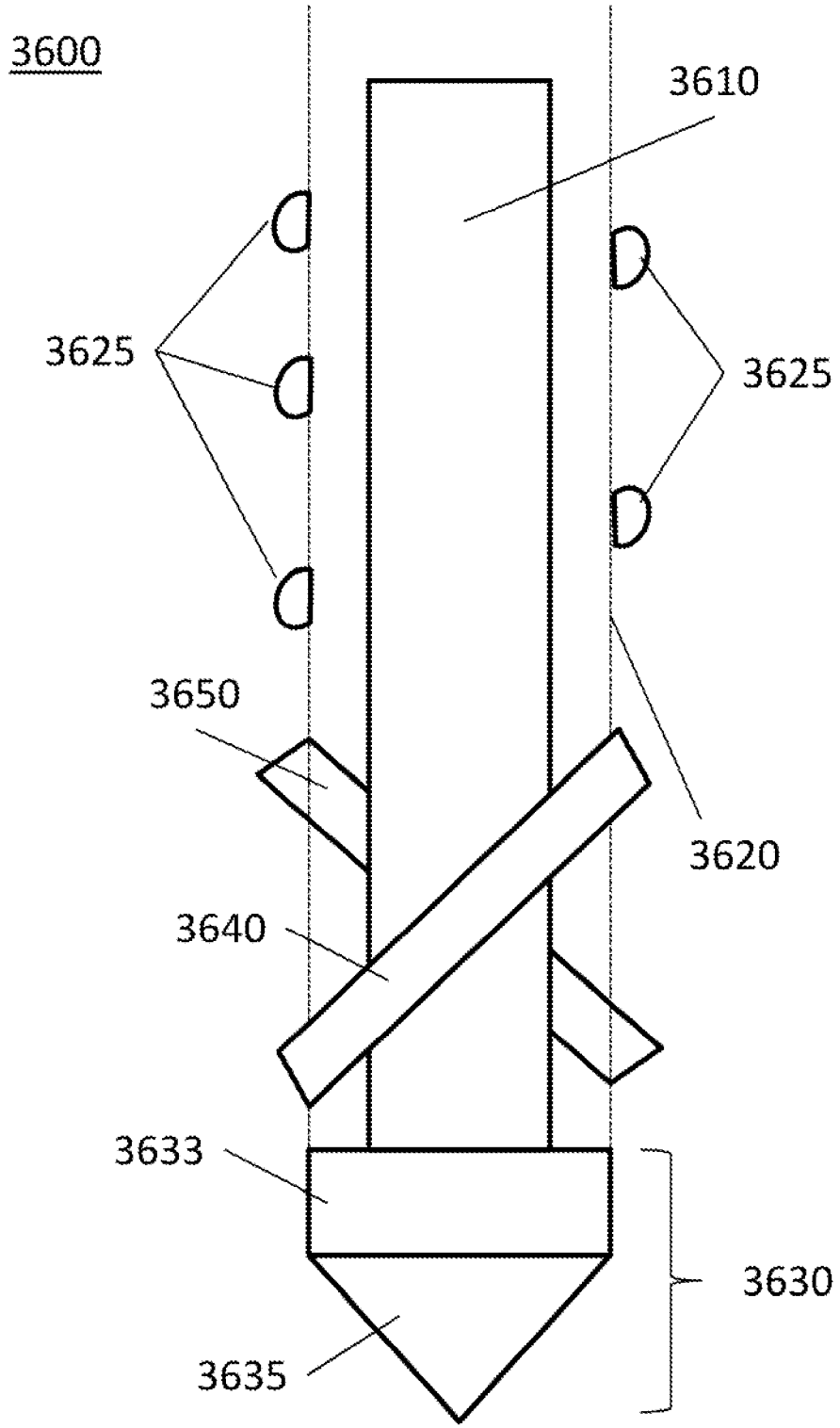
FIG. 36 illustrates a pound driven pile with fins.

FIG. 36 illustrates a pound-driven pile 3600 that includes fins (3640 and 3650). A pound-driven pile is a pile that is driven into the medium (ground) solely by a pile driver that pounds (hammers) the pile. The pile driver applies no rotation to the pile as it is driven.

As illustrated in FIG. 36, the pound-driven pile 3600 includes a shaft 3610 and a displacement head 3630 that includes a head 3625 for transferring the force from the pounding to the medium to break up the medium and a lateral compaction member 3623 for laterally compacting the medium to create an annulus 3620 in the medium.

The shaft 3610 has fins (3640 and 3650) orientated at different angles. The fins (3640 and 3650) orientated such that when the pound-driven pile 3600 is pounded by the pile driver, the fins (3640 and 3650) cause the pound-driven pile 3600 to rotate.

The fins (3640 and 3650) are solid projections that extend outwardly from the shaft 3610. The fins (3640 and 3650) extend outwardly enough from the shaft 3610 to engage the annulus 3610 and cut continuous grooves 3625 into the wall of the annulus 3610. The continuous grooves 3625 prevent shearing at the interface between the grout and the wall of the annulus 3610.

The shaft 3610 may be hollow to allow the introduction of grout into the annulus 3620. Moreover, the displacement head 3630 may include an opening to allow the introduction of grout into the annulus 3620.

The shaft 3610 may include threads, projections, and/or indentations, as illustrated in FIG. 2, 3, 4, or 5. The threads, projections, and/or indentations of shaft 3610 provide a gripping interface between the grout introduced into the annulus 3620 and the shaft 3610, as well as, providing an interface that resists the grout from shearing along the surface between the grout and the shaft 3610.

Figure 37:
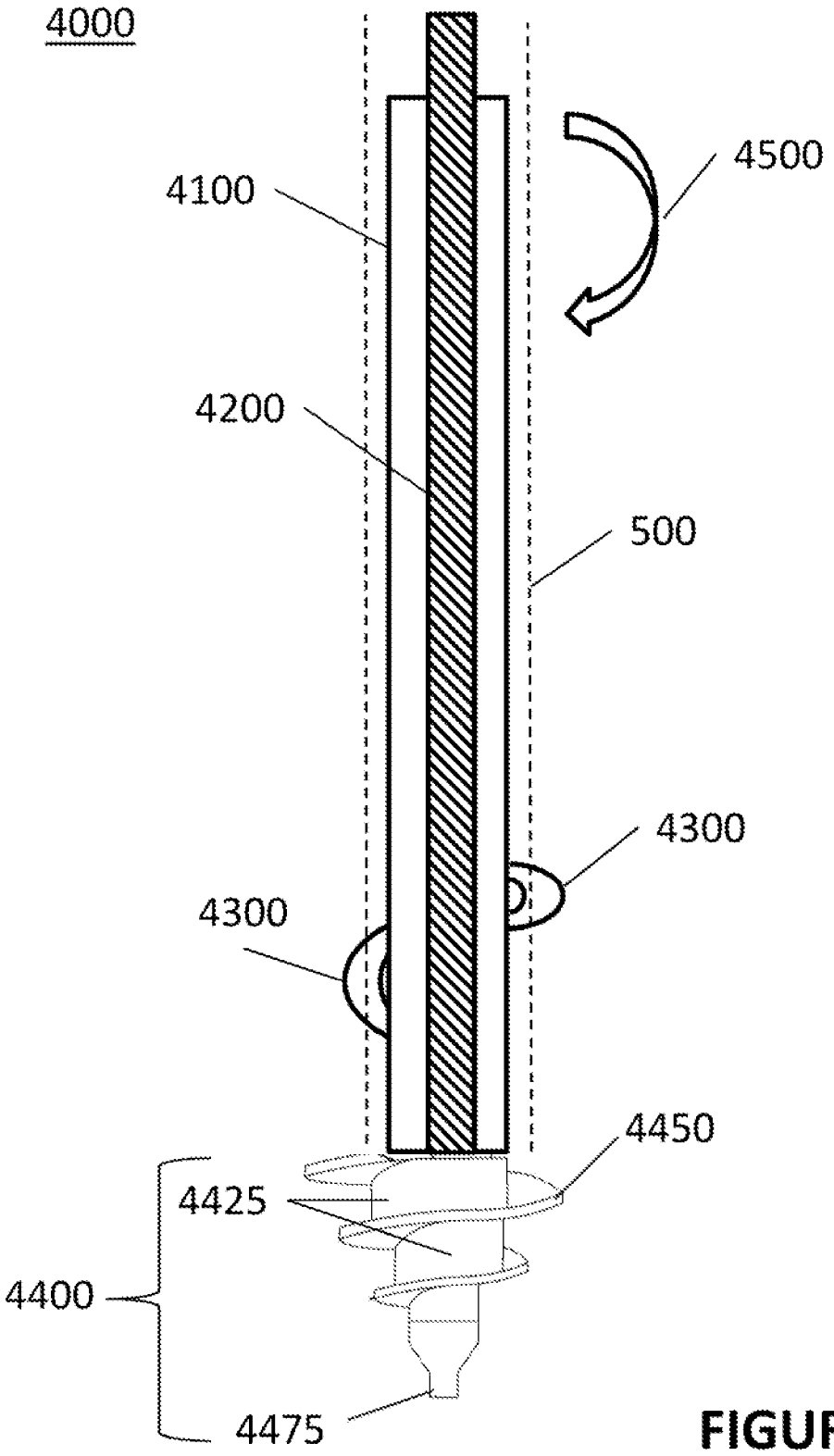
FIG. 37 illustrates a micropile with an attached detachable casing having a helix.

FIG. 37 illustrates a micropile 4000 that includes a casing 4100. A pile shaft 4200 is located within the casing 4100. A displacement head 4400 is connected to the pile shaft 4200. The displacement head 4400 creates an annulus 500 in a medium (such as soil) as the displacement head 4400 is driven (rotated in direction 4500) into the medium.

As illustrated in FIG. 37, the displacement head 4400 may include a helical blade 4450 having a leading edge and a trailing edge. The driving helical blade 4450 is configured to move the displacement head 4400 into the medium. The displacement head 4400 also may include a lateral compaction member 4425 to create the annulus 500 within the medium. The lateral compaction member 4425 has a diameter equal to or larger than a diameter of the casing 4100. The displacement head 4400 may include a displacement head point member 4475.

The micropile 4000, as illustrated in FIG. 37, includes a helical blade 4300 on the casing 4100. The helical blade 4300 is configured to drive the casing 4100 out of a medium when the casing 4100 is rotated in the direction 4550, as illustrated in FIG. 38.

Figure 38:
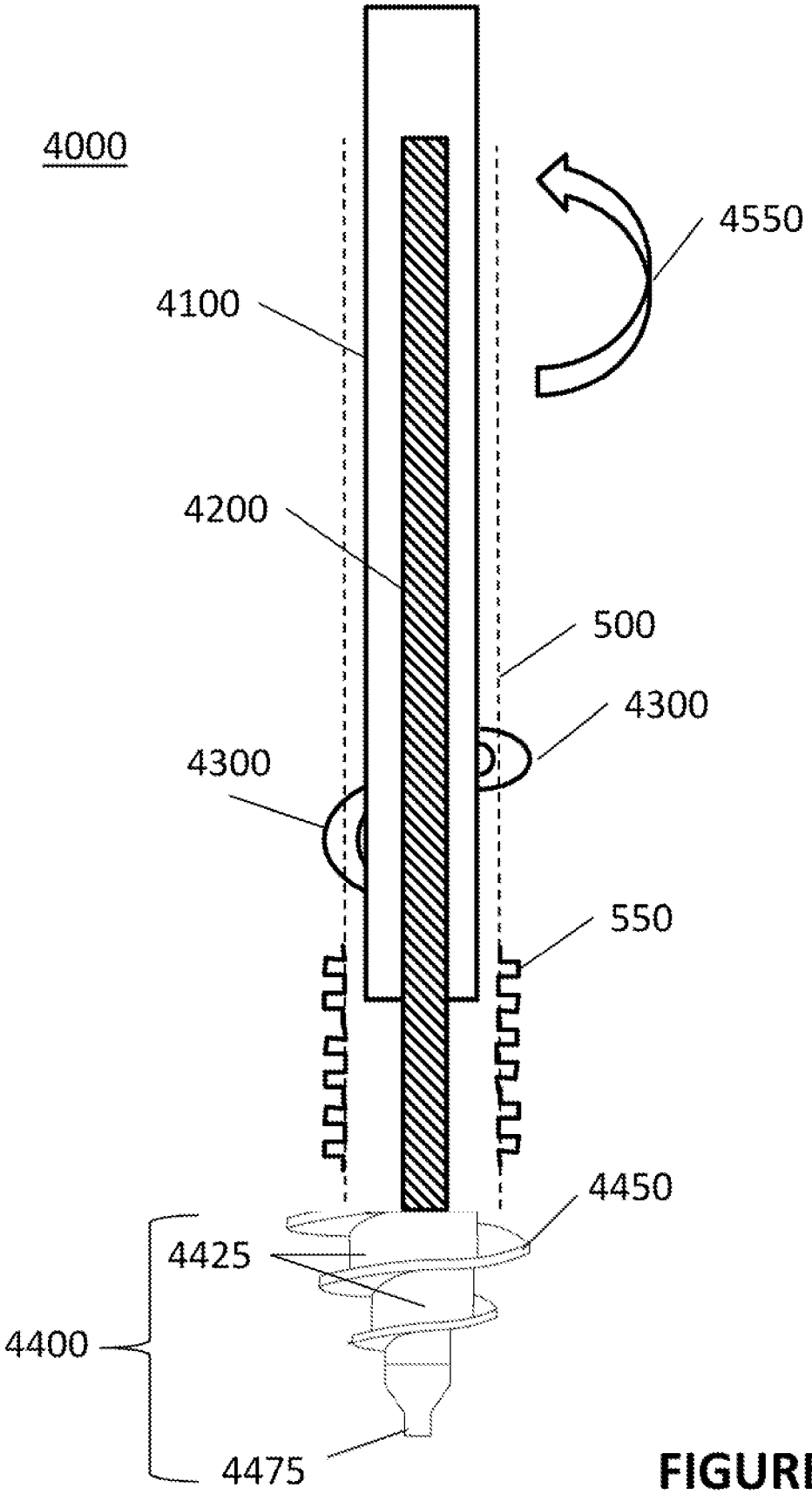
FIG. 38 illustrates the micropile of FIG. 37 with the casing being detached from a displacement head.

More specifically, as illustrated in FIG. 38, as the casing 4100, with helical blade 4300, is rotated in the direction 4550, the casing 4100 travels out of the medium, and the helical blade 4300 creates deformations 550 in the wall of the annulus 500. The deformations 550 assist in preventing shear between a grout (not shown), which is used to fill the annulus 500, and the wall of the annulus 500.

Figure 39:
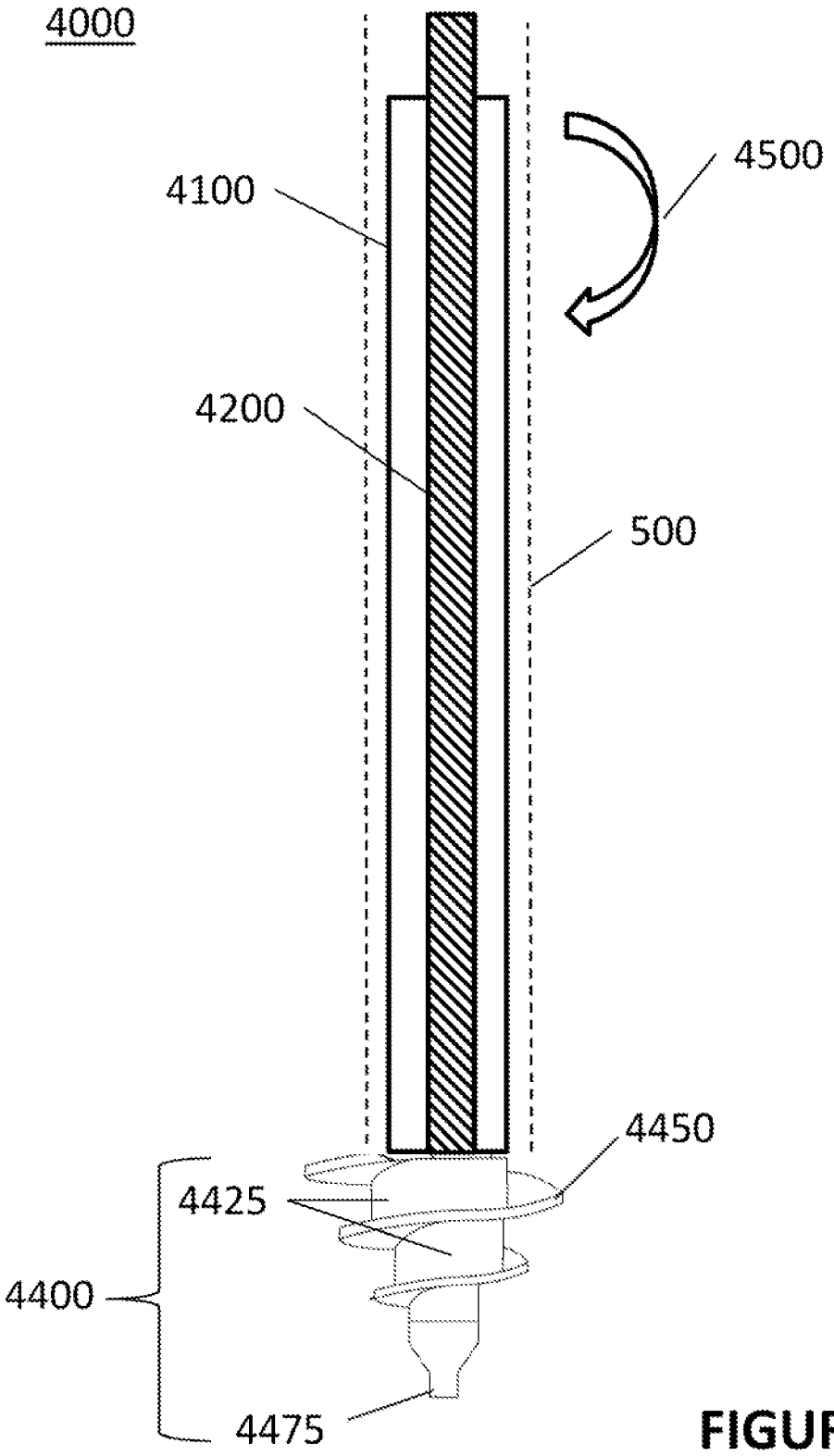
FIG. 39 illustrates a micropile with an attached detachable casing without a helix.

FIG. 39 illustrates a micropile 4000 that includes a casing 4100. A pile shaft 4200 is located within the casing 4100. A displacement head 4400 is connected to the pile shaft 4200. The displacement head 4400 creates an annulus 500 in a medium as the displacement head 4400 is driven (rotated in direction 4500) into the medium.

As illustrated in FIG. 39, the displacement head 4400 may include a helical blade 4450 having a leading edge and a trailing edge. The driving helical blade 4450 is configured to move the displacement head 4400 into the medium. The displacement head 4400 also may include a lateral compaction member 4425 to create the annulus 500 within the medium. The lateral compaction member 4425 has a diameter equal to or larger than a diameter of the casing 4100. The displacement head 4400 may include a displacement head point member 4475.

The micropile 4000, as illustrated in FIG. 39, does not include a helical blade on the casing.

Figure 40:
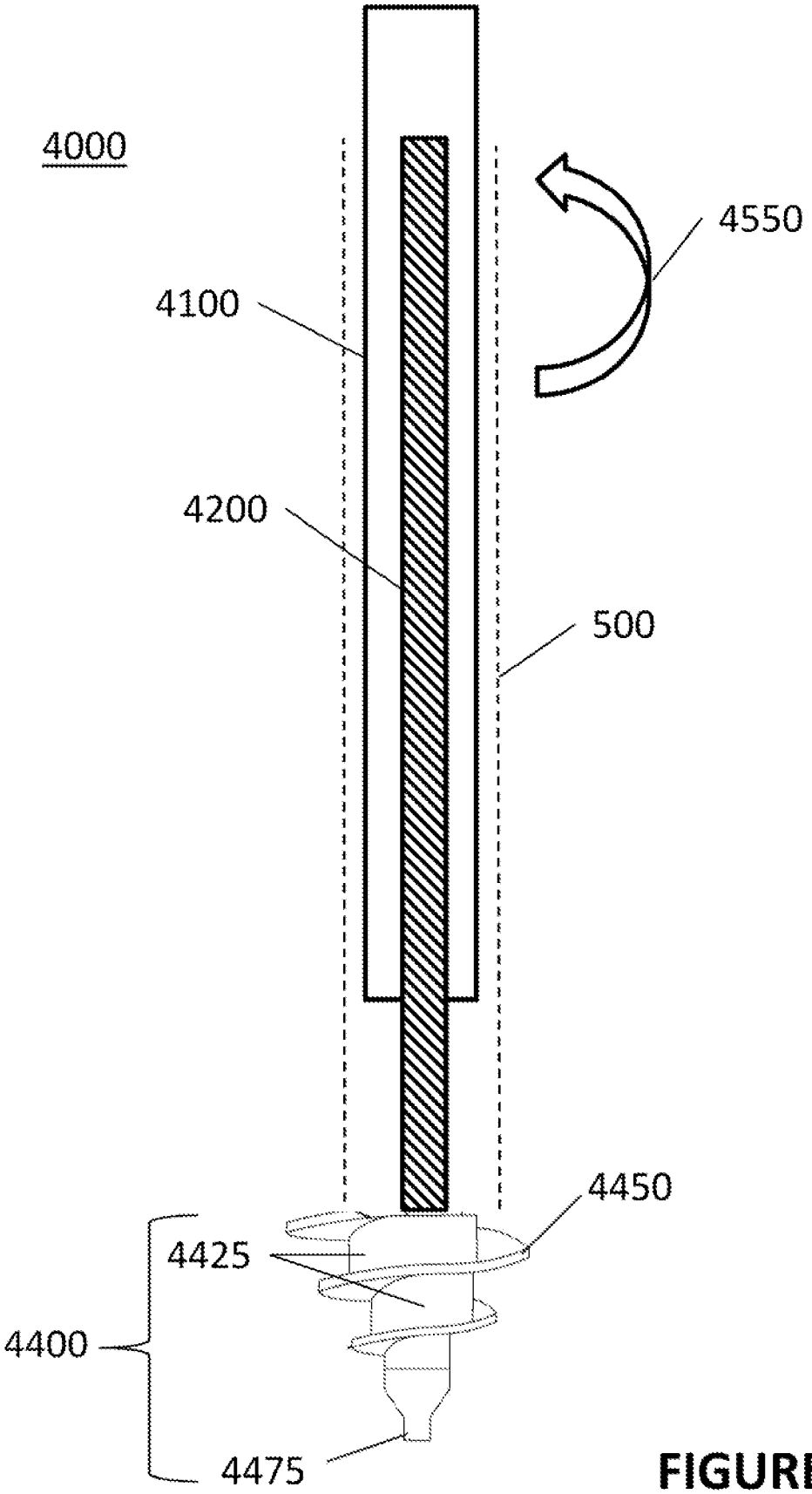
FIG. 40 illustrates the micropile of FIG. 39 with the casing being detached from a displacement head.

As illustrated in FIG. 40, the casing 4100 is disengaged from the displacement head 4500 when the casing 4100 is rotated in the direction 4550. This allows the displacement head 4500 to remain in place in the medium as the casing 4100 is moved away from the displacement head 4500 or out of the annulus 500. The casing 4100 maintains the integrity of the annulus 500 as the micropile 4000 is driven into the medium, and the casing 4100 can be removed after the micropile 4000 has been driven to a desired depth in the medium. The casing 4100 can be removed as grout or other filling material is pumped into the annulus 500.

Figure 41:
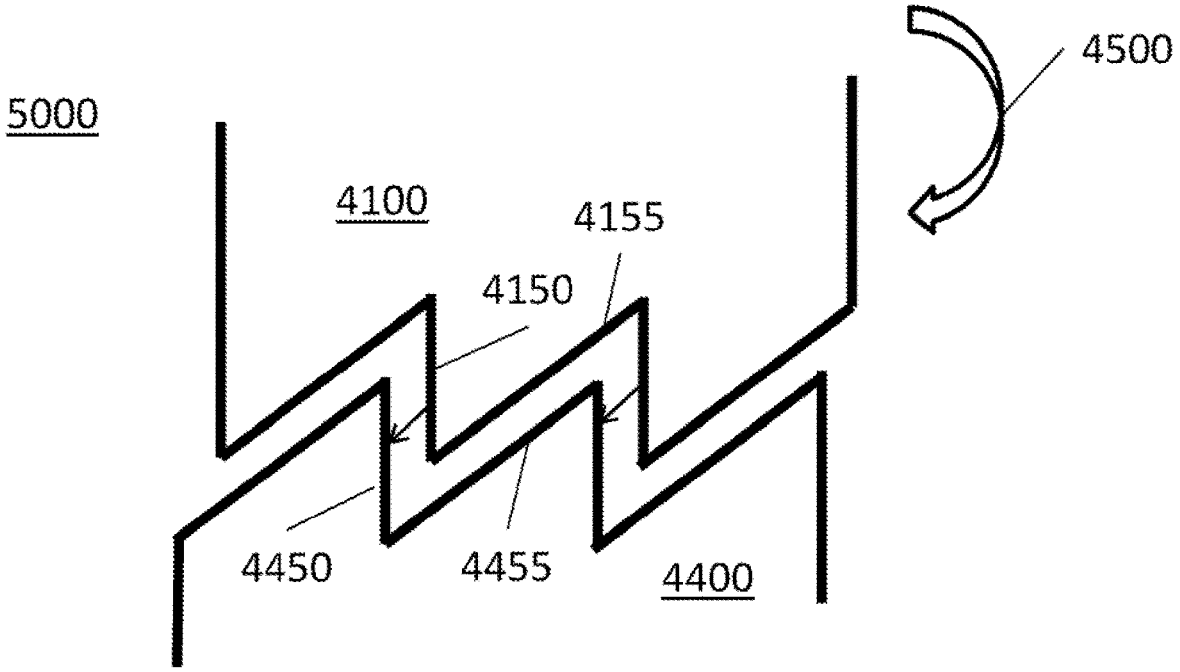
FIG. 41 illustrates an engaging interface between a detachable casing and a displacement head.
Figure 42:
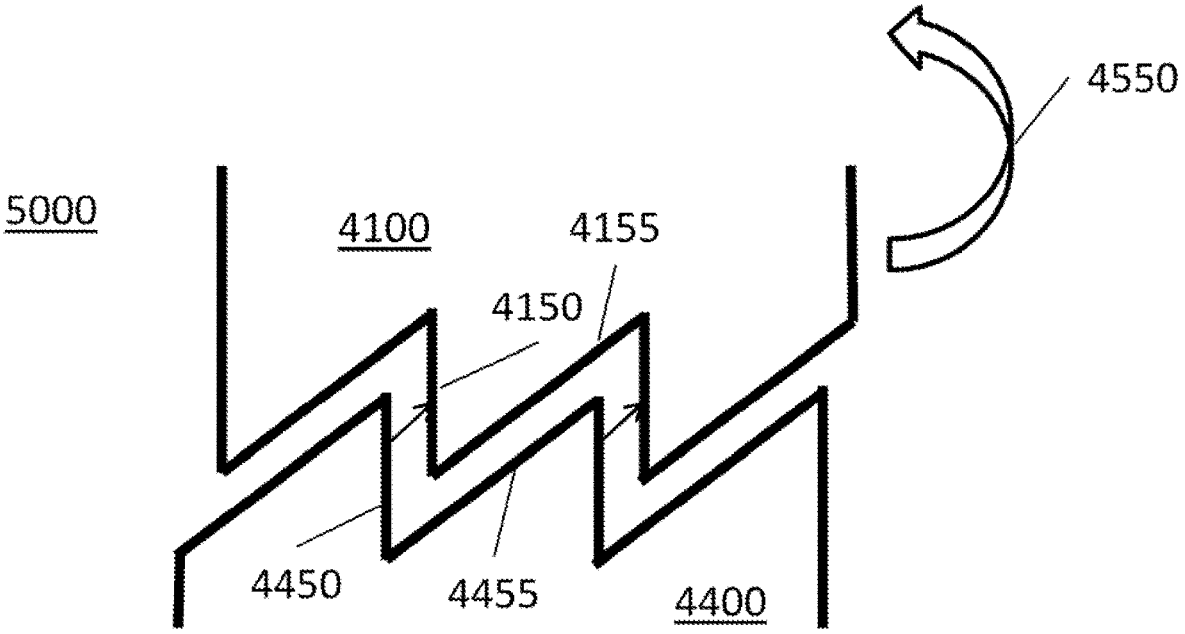
FIG. 42 illustrates a disengaging interface between a detachable casing and a displacement head.

As illustrated in FIGS. 41 and 42, the casing 4100 and displacement head 4400 have an interface 5000. More specifically, casing 4100 has an interface that includes surface 4150 and surface 4155, and displacement head 4400 has an interface that includes surface 4450 and surface 4455.

It is note that surface 4150 is non-orthogonal to surface 4155, and surface 4450 is non-orthogonal to surface 4455.

As illustrated in FIG. 41, as the casing is rotated in direction 4500, the surface 4150 of casing 4100 engages the surface 4450 of displacement head 4400, as shown by the arrows. More specifically, as the casing is rotated in direction 4500, the surface 4150 of casing 4100 engages the surface 4450 of displacement head 4400 so that torque, if desired, can be transferred from the casing 4100 to the displacement head 4500. The surfaces 4150 and 4450 are orientated to enable effective transference of torque; preferably, the surfaces 4150 and 4450 are substantially orthogonal to the direction of torque being applied thereto.

As illustrated in FIG. 42, as the casing 4100 is rotated in direction 4550, the surface 4150 of casing 4100 disengages the surface 4450 of displacement head 4400, as shown by the arrows. The surfaces 4155 and 4455 are orientated so as to enable effective disengagement when the casing is rotated in direction 4550; preferably, the surfaces 4155 and 4455 are substantially parallel or non-orthogonal to the direction of torque being applied thereto when the casing is rotated in direction 4500.

This allows the displacement head 4500 to remain in place in the medium as the casing 4100 is moved away from the displacement head 4500 or out of the annulus 500. The casing 4100 maintains the integrity of the annulus 500 as the micropile 4000 is driven into the medium, and the casing 4100 can be removed after the micropile 4000 has been driven to a desired depth in the medium. The casing 4100 can be removed as grout or other filling material is pumped into the annulus 500.

The interface 5000 of FIGS. 41 and 42 allows the casing 4100 to be removed from the annulus or moved away from the displacement head 4500, while leaving the displacement head 4500 in place.

As illustrated in FIGS. 41 and 42, the interface of the casing 4100 is configured to engage the interface of the displacement head 4500 when the casing is rotated in a first direction (4500), and the interface of the casing 4100 is configured to disengage from the interface of the displacement head 4500 when the casing is rotated in a second (opposite) direction (4550).

This allows the displacement head 4500 to remain in place in the medium as the casing 4100 is moved away from the displacement head 4500 or out of the annulus 500. The casing 4100 maintains the integrity of the annulus 500 as the micropile 4000 is driven into the medium, and the casing 4100 can be removed after the micropile 4000 has been driven to a desired depth in the medium. The casing 4100 can be removed as grout or other filling material is pumped into the annulus 500.

It is noted that the displacement head 4500 may include a deformation structure to form a deformation in a wall of the annulus created by the displacement head 4500.

It is noted that the torque needed to drive the displacement head 4500 into the medium can be supplied by rotating the casing 4100 or the pile shaft 4200 or a combination of both.

Figure 43:
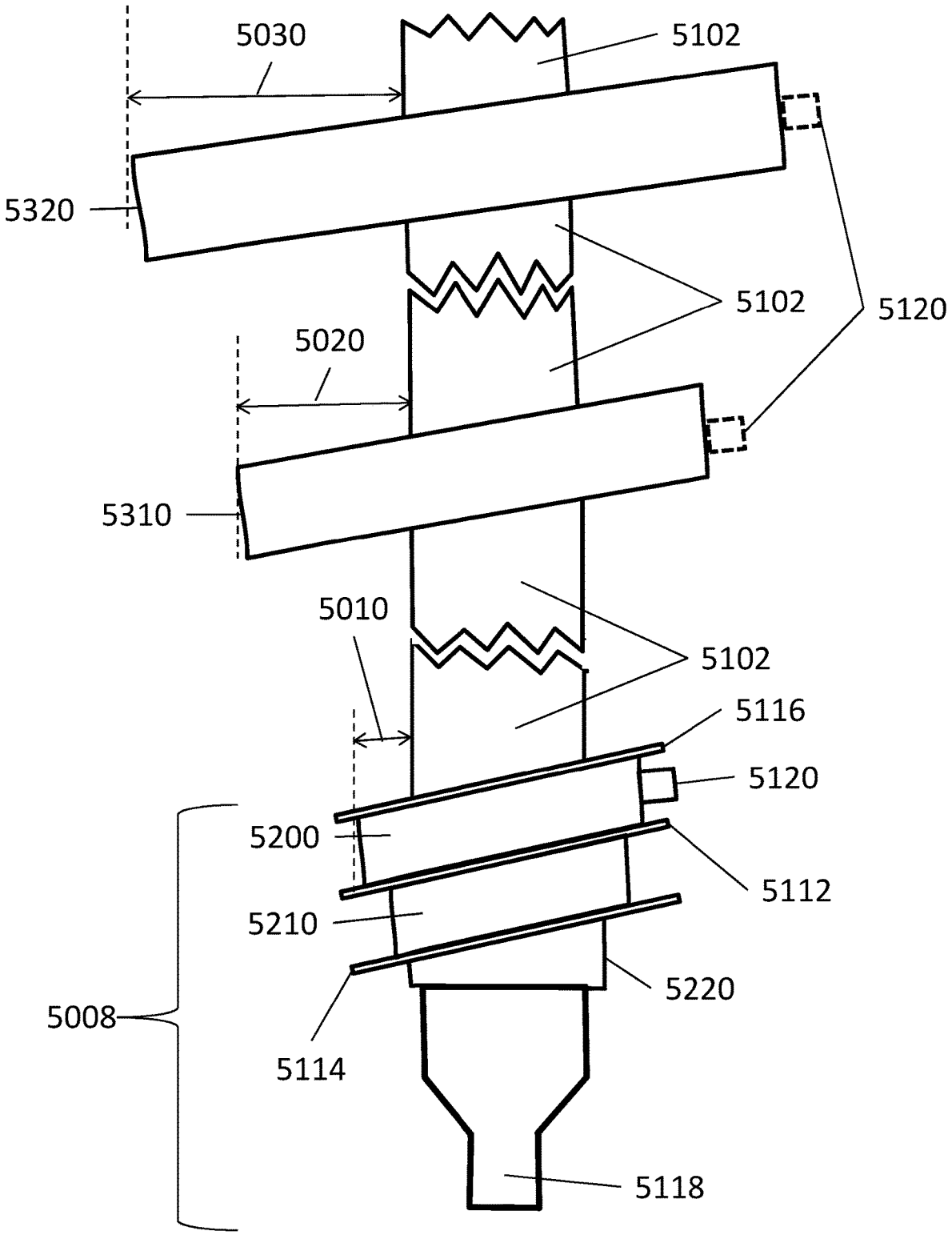
FIG. 43 illustrates a pile with different sized lateral compaction elements.

FIG. 43 illustrates a pile with different sized lateral compaction elements above the displacement head of the pile. As illustrated in FIG. 43, a pile includes a shaft 5102 and soil (medium) displacement head 5008 having a cutting blade 5112 that has a leading edge 5114 and a trailing edge 5116.

The leading edge 5114 of cutting blade 5112 cuts into the soil (medium) as the displacement pile is rotated and loosens the soil (medium) at such contact point. The soil (medium) displacement head 5008 may be equipped with a point 5118 to promote this cutting.

The loosened soil (medium) passes over cutting blade 5112 and thereafter past trailing edge 5116.

The soil (medium) displacement head 5008 includes at least one lateral compaction element. In the embodiment shown in FIG. 43, there are at least five lateral compaction elements. The lateral compaction element 5220 has a diameter less than the diameter of the lateral compaction element 5200. The lateral compaction element 5210 has a diameter that is between the diameters of the lateral compaction element 5220 and the lateral compaction element 5200. In this fashion, the soil is laterally compacted by the first lateral compaction element 5220, more compacted by the second lateral compaction element 5210 (enlarging the diameter of the bored hole) and even more compacted by the third lateral compaction element 5200. The lateral compaction elements (5220, 5210, and 5200), as the soil (medium) displacement head 5008 is rotated into the soil (medium), laterally compacts the soil (medium) to create an annulus or bore, having the walls thereof a first distance 5010 from the shaft 5102.

As illustrated in FIG. 43, the lateral compaction element 5200 includes, thereon, a deformation structure 5120 that cuts into or gouges the wall of the annulus or bore created by lateral compaction elements (5220, 5210, and 5200), so as to create a deformation in the wall of the annulus or bore. The deformation in the wall of the annulus or bore assists in preventing shearing between the grout and the soil (medium).

As further illustrated in FIG. 43, the annulus or bore is further widened by lateral compaction elements (5310 and 5320) located on the shaft 5102, above the soil (medium) displacement head 5008. The lateral compaction element 5310 widens the annulus or bore such that the walls thereof, formed by the lateral compaction element 5310, have a second distance 5020 from the shaft 5102. Moreover, the lateral compaction element 5320 further widens the annulus or bore such that the walls thereof, formed by the lateral compaction element 5330, have a third distance 5030 from the shaft 5102.

It is noted that these lateral compaction elements (5310 and 5320) may include, thereon, a deformation structure 5120 that cuts into or gouges the wall of the annulus or bore created by lateral compaction elements (5310 and 5320).

The pile illustrated in FIG. 43 creates a stepped or variable annulus or bore, wherein the diameter of the annulus or bore incrementally increases in a direction away from the soil (medium) displacement head 5008. The actual incremental increases depend on the number of lateral compaction elements located on the shaft 5102, above the soil (medium) displacement head 5008, wherein each lateral compaction element is a distinct size so as to annulus or bore walls that having varying distances from the from the shaft 5102.

Figure 44:
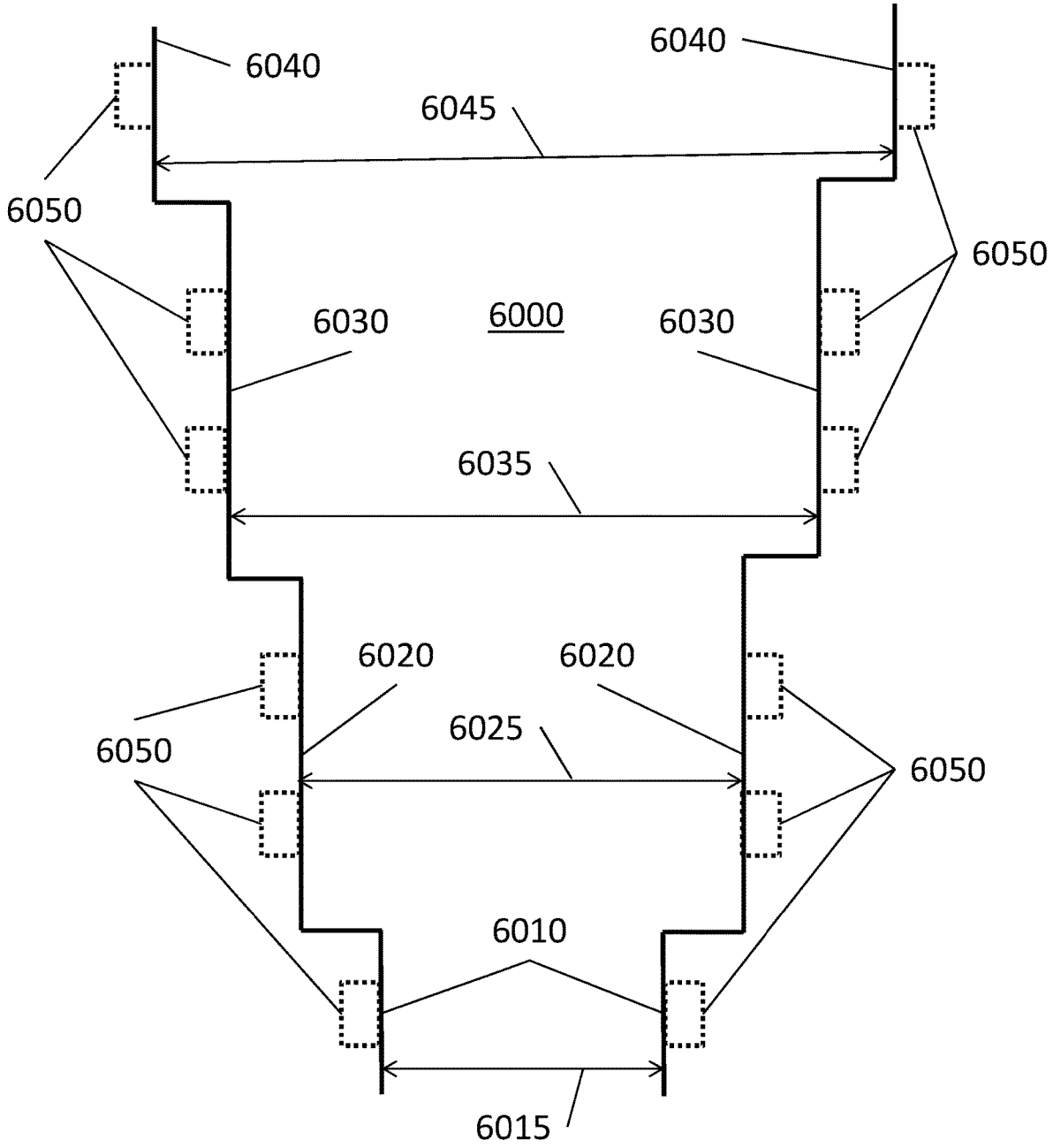
FIG. 44 illustrates a stepped lateral compaction element.

FIG. 44 illustrates a stepped lateral compaction element. As illustrated in FIG. 4, a stepped lateral compaction element 6000 has a plurality of sections that have different diameters. It is noted that the stepped lateral compaction element 6000 may be located on a shaft of a pile above the displacement head.

In a first section, defined by walls 6010, the stepped lateral compaction element 6000 has a first diameter 6015 (a distance between walls 6010) that creates an annulus or bore with a diameter approximately equal to the first diameter 6015. It is noted that the exterior of the walls 6010 may include deformation structures 6050 that cuts into or gouges the wall of the annulus or bore created by the first section, defined by walls 6010, the stepped lateral compaction element 6000.

In a second section, defined by walls 6020, the stepped lateral compaction element 6000 has a second diameter 6025 (a distance between walls 6020) that creates an annulus or bore with a diameter approximately equal to the second diameter 6025. It is noted that the exterior of the walls 6020 may include deformation structures 6050 that cuts into or gouges the wall of the annulus or bore created by the second section, defined by walls 6020, the stepped lateral compaction element 6000. The second diameter 6025 is greater than the first diameter 6015.

In a third section, defined by walls 6030, the stepped lateral compaction element 6000 has a third diameter 6035 (a distance between walls 6030) that creates an annulus or bore with a diameter approximately equal to the third diameter 6035. It is noted that the exterior of the walls 6030 may include deformation structures 6050 that cuts into or gouges the wall of the annulus or bore created by the third section, defined by walls 6030, the stepped lateral compaction element 6000. The third diameter 6035 is greater than the second diameter 6025.

In a fourth section, defined by walls 6040, the stepped lateral compaction element 6000 has a fourth diameter 6045 (a distance between walls 6040) that creates an annulus or bore with a diameter approximately equal to the fourth diameter 6045. It is noted that the exterior of the walls 6040 may include deformation structures 6050 that cuts into or gouges the wall of the annulus or bore created by the fourth section, defined by walls 6040, the stepped lateral compaction element 6000. The fourth diameter 6045 is greater than the third diameter 6035.

It is noted that the stepped lateral compaction element 6000 may have only two sections. It is further noted that the stepped lateral compaction element 6000 may have more than four sections.

A pile picking adapter comprises a driver coupling member to enable coupling of the pile picking adapter to a pile driving unit; a swivel; and a pile coupling member to enable coupling of the pile picking adapter to a pile.

The swivel may be configured to enable the pile coupling member to swivel 180° with respect to the driver coupling member. The pile coupling member may include a pile backing stop plate, swivel engagement members, and pile wings; the swivel engagement members being orthogonal to the pile backing stop plate; the pile wings being orthogonal to the pile backing stop plate.

The pile coupling member may include a pile adapter surface for providing engagement and alignment when attaching a pile to the pile picking adapter.

A bi-directional swing pile adapter comprises a first ring; a first support arm; a second support arm; a first swivel connector to operatively connect the first ring to the first support arm in a swivel manner; a second swivel connector to operatively connect the first ring to the second support arm in a swivel manner; a pile coupling member to enable coupling to a pile; a third swivel connector to operatively connect the first ring to the pile coupling member in a swivel manner; and a fourth swivel connector to operatively connect the first ring to the pile coupling member in a swivel manner.

The bi-directional swing pile adapter may include a cross support bar operatively connected to the first support arm and the second support arm. The bi-directional swing pile adapter may include a driver attachment member for coupling a pile to a pile driver. The bi-directional swing pile adapter may include a supporting excavation member attachment member for coupling a pile to supporting excavation members.

The first swivel connector and the second swivel connector may provide a swing equal to or greater than 40°. The third swivel connector and the fourth swivel connector may provide a swing equal to or greater than 20°.

The third swivel connector and the fourth swivel connector may provide a swing equal to or greater than 20°.

The swing provided by the first swivel connector and the second swivel connector may be orthogonal to the swing provided by the third swivel connector and the fourth swivel connector.

The first swivel connector and the second swivel connector may provide a swing equal to or greater than 40° in a direction orthogonal to the cross support bar.

The third swivel connector and the fourth swivel connector may provide a swing equal to or greater than 20° in a direction parallel to the cross support bar.

A pile for use with supporting excavation members, comprises a pile shaft; and vertical flanges; the vertical flanges including through-holes to enable attaching supporting excavation members thereto.

The vertical flanges may be welded to the pile shaft.

The pile may include braces, the braces being welded to the pile shaft and the vertical flanges.

A pile for use with supporting excavation members, comprises a pile shaft; and a mating vertical coupling component for mating with a vertical coupling component of a supporting excavation member.

The mating vertical coupling component may be welded to the pile shaft.

A pile for use with supporting excavation members, comprises a pile shaft; and a C-shaped vertical flange; the C-shaped vertical flange including through-holes to enable attaching supporting excavation members thereto.

The C-shaped vertical flange may be welded to the pile shaft.

A pile for being placed in a medium comprises a pile shaft; a helical blade, operatively connected to the pile shaft, having a leading edge and a trailing edge and configured to move the pile into the medium; a lateral compaction protrusion to create an annulus, within the medium, having a diameter larger than a diameter of the elongated pile shaft; and a lateral retention element, extending beyond the trailing edge of the helical blade, for preventing a portion of the annulus, above the trailing edge of the helical blade, from collapsing.

The pile may include a deformation structure to form a deformation in a wall of the annulus created by the lateral compaction protrusion.

The deformation structure may be formed on the lateral compaction protrusion. The deformation structure may be formed on the lateral retention element.

The pile may include a helical auger, operatively connected to the elongated pile shaft, configured to move material; the helical blade having a first handedness; the helical auger having a second handedness; the first handedness being different than the second handedness.

The lateral retention element may extend one turn around the pile shaft. The lateral retention element may extend more than one turn around the pile shaft. The lateral retention element may extend less than one turn around the pile shaft.

The pile may include a second lateral retention element, extending beyond the trailing edge of the helical blade, for preventing a portion of the annulus, above the trailing edge of the helical blade, from collapsing.

The deformation structure may be formed on the second lateral retention element.

The second lateral retention element may extend one turn around the pile shaft. The second lateral retention element may extend more than one turn around the pile shaft. The second lateral retention element may extend less than one turn around the pile shaft.

The lateral retention element may be a hollow cylinder extending beyond the trailing edge of the helical blade, for preventing a portion of the annulus, above the trailing edge of the helical blade, from collapsing. The lateral retention element may include spacers located within the hollow cylinder.

A pile for being placed in a medium comprises a pile shaft; soil displacement head, operatively connected to the pile shaft, configured to move the pile into the medium and to create an annulus in the medium; a helical auger, operatively connected to the pile shaft, configured to move material; and a lateral retention element, extending beyond the displacement head, for preventing a portion of the annulus, above the displacement head, from collapsing.

The pile may include a deformation structure to form a deformation in a wall of the annulus created by the displacement head. The deformation structure may be formed on the lateral retention element.

A pile for being placed in a medium comprising a pile shaft; a displacement head, operatively connected to an end of the pile shaft, configured to move the pile into the medium and to create an annulus in the medium; a stepped lateral compaction element, operatively connected to the pile shaft to create a stepped annulus within the medium; the stepped lateral compaction element having a first section defined by first walls, the first walls having a first distance therebetween; the stepped lateral compaction element having a second section defined by second walls, the second walls having a second distance therebetween, the second distance being greater than the first distance; the second section of the stepped lateral compaction element being located on the pile shaft further away from the displacement head than the first section of the stepped lateral compaction element.

The stepped lateral compaction element may include a third section defined by third walls, the third walls having a third distance therebetween, the third distance being greater than the second distance; the third section of the stepped lateral compaction element being located on the pile shaft further away from the displacement head than the second section of the stepped lateral compaction element.

The stepped lateral compaction element may include a fourth section defined by fourth walls, the fourth walls having a fourth distance therebetween, the fourth distance being greater than the third distance; the fourth section of the stepped lateral compaction element being located on the pile shaft further away from the displacement head than the third section of the stepped lateral compaction element.

The may include deformation structures to form a deformation in a wall of the annulus created by the lateral compaction protrusion; the deformation structures being formed on an exterior of the first walls and the second walls.

A pile for being placed in a medium comprising a pile shaft; a point to promote cutting into the medium; a helical blade, operatively connected to the pile shaft above the point, having a leading edge and a trailing edge and configured to move the pile into the medium; a first lateral compaction element, operatively connected to the pile shaft above the helical blade, to create a first annulus portion, within the medium, the first annulus portion having a first diameter, the first diameter being larger than a diameter of the elongated pile shaft; the helical blade being operatively connected to the pile shaft between the point and the first lateral compaction element; and a second lateral retention element, operatively connected to the pile shaft above the first lateral compaction element, to create a second annulus portion, within the medium, the second annulus portion having a second diameter, the second diameter being larger than the first diameter; the first lateral compaction element being operatively connected to the pile shaft between the helical blade and the second lateral compaction element.

The pile may include deformation structures to form a deformation in a wall of the annulus created by the lateral compaction protrusion; the deformation structures being formed on the first lateral compaction element and the second lateral compaction element.

A pound-driven pile comprises a pile shaft; a displacement head, located at one end of the pile shaft; the displacement head including a head member for transferring a force from pounding the pile to a medium and a lateral compaction member for laterally compacting the medium to create an annulus; and a fin, extending outwardly from the shaft, to cut a continuous groove into a wall of the annulus created by the lateral compaction member.

The fin may be configured to cause the pile to rotate when driven into the medium from the pounding. The displacement head may include an opening to allow grout to be pumped into the annulus.

The pile shaft may include threads to prevent shearing between the pile shaft and grout; projections to prevent shearing between the pile shaft and grout; and/or indentations to prevent shearing between the pile shaft and grout.

A pound-driven pile comprises a pile shaft; a displacement head, located at one end of the pile shaft; the displacement head including a head member for transferring a force from pounding the pile to a medium and a lateral compaction member for laterally compacting the medium to create an annulus; and fins, extending outwardly from the shaft, to cut continuous grooves into a wall of the annulus created by the lateral compaction member.

The fins may be configured to cause the pile to rotate when driven into the medium from the pounding. The displacement head may include an opening to allow grout to be pumped into the annulus.

The pile shaft may include threads to prevent shearing between the pile shaft and grout; projections to prevent shearing between the pile shaft and grout; and/or indentations to prevent shearing between the pile shaft and grout.

A micropile comprises a casing; a shaft, located within the casing; and a displacement head, connected to the shaft, to create an annulus in a medium; the casing having a casing interface for interfacing with a displacement head interface of the displacement head; the casing interface configured to engaged the displacement head interface when the casing is rotated in a first direction; the casing interface configured to disengaged from the displacement head interface when the casing is rotated in a second direction.

The displacement head may include a helical blade having a leading edge and a trailing edge and configured to move the displacement head into the medium; and a lateral compaction member to create the annulus, within the medium, having a diameter equal to or larger than a diameter of the casing.

The casing may include a helical blade, the helical blade configured to drive the casing out of a medium when the casing is rotated in the second direction.

The casing may include a helical blade, the helical blade configured to create a deformation in a wall of the annulus.

The displacement head may include a deformation structure to form a deformation in a wall of the annulus created by the displacement head.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A pile for being placed in a medium, the pile comprising:

a pile shaft having a first diameter;

a cutting blade, operatively connected to said pile shaft, having a leading edge and a trailing edge, said cutting blade being configured to move said pile shaft into the medium, said cutting blade having a second diameter, said second diameter being greater than said first diameter;

a lateral compaction element, operatively connected to said pile shaft, to create an annulus within the medium, said lateral compaction element having a third diameter, said second diameter being greater than said third diameter, said third diameter being greater than said first diameter; and a lateral retention element, located above said trailing edge of said cutting blade, configured to prevent a portion of the annulus, above said trailing edge of said cutting blade, from collapsing;

said lateral retention element having a fourth diameter, said third diameter being equal to said fourth diameter;

said lateral compaction element being located only between said leading edge and said trailing edge of said cutting blade;

said lateral retention element being configured to be in direct contact with said trailing edge of said cutting blade;

said fourth diameter of said lateral retention element being located at the contact between said lateral retention element and said trailing edge of said cutting blade.

2. The pile, as claimed in claim 1, further comprising a deformation structure configured to form a deformation in a wall of the annulus created by said lateral compaction element.

3. The pile, as claimed in claim 2, wherein said deformation structure is formed on said lateral compaction element.

4. The pile, as claimed in claim 1, wherein said lateral retention element extends completely around said pile shaft.

5. The pile, as claimed in claim 1, wherein said lateral retention element is operatively connected to said cutting blade at said trailing edge of said cutting blade.

6. The pile, as claimed in claim 1, wherein said lateral retention element is operatively connected to said pile shaft.

7. The pile, as claimed in claim 1, wherein said lateral retention element extends less than completely around said pile shaft.

8. The pile, as claimed in claim 1, further comprising a second lateral retention element, located above said trailing edge of said cutting blade, for preventing a portion of the annulus, above said trailing edge of said cutting blade, from collapsing.

9. The pile, as claimed in claim 8, further comprising a deformation structure to form a deformation in a wall of the annulus created by said lateral compaction element;

said deformation structure being formed on said second lateral retention element.

10. The pile, as claimed in claim 8, wherein said second lateral retention element extends completely around said pile shaft.

11. The pile, as claimed in claim 8, wherein said second lateral retention element extends less than completely around said pile shaft.

12. The pile, as claimed in claim 1, wherein said lateral retention element is a hollow cylinder located above said trailing edge of said cutting blade, for preventing a portion of the annulus, above said trailing edge of said cutting blade, from collapsing.

13. The pile, as claimed in claim 12, wherein said lateral retention element includes spacers located within said hollow cylinder.

* * * * *